US012753595B2

(12) United States Patent
Slothower et al.

(10) Patent No.: US 12,753,595 B2
(45) Date of Patent: Oct. 6, 2026

(54) SINK SYSTEM WITH SEAMLESS DRAIN AND ATTACHMENT BAYONET

(71) Applicant: Kohler Co., Kohler, WI (US)

(72) Inventors: Erich Slothower, Kohler, WI (US); Todd Leonhard, Kohler, WI (US); Kenneth Andrew Kapal, Sheboygan, WI (US); Jason R. Miller, Plymouth, WI (US); Thomas Spankowski, Kohler, WI (US)

(73) Assignee: Kohler Co., Kohler, WI (US)

( * ) Notice: Subject to any disclaimer, the term of this patent is extended or adjusted under 35 U.S.C. 154(b) by 93 days.

(21) Appl. No.: 18/585,747

(22) Filed: Feb. 23, 2024

(65) Prior Publication Data

US 2024/0295103 A1 Sep. 5, 2024

Related U.S. Application Data

(60) Provisional application No. 63/488,323, filed on Mar. 3, 2023.

(51) Int. Cl.
*E03C 1/22* (2006.01)
*E03C 1/182* (2006.01)
*E03C 1/264* (2006.01)

(52) U.S. Cl.
CPC ..... *E03C 1/22* (2013.01); *E03C 1/182* (2013.01); *E03C 1/264* (2013.01)

(58) Field of Classification Search
CPC ..... E03C 1/22; E03C 1/182; E03C 1/264
See application file for complete search history.

(56) References Cited

U.S. PATENT DOCUMENTS

| | | | | |
|---|---|---|---|---|
| 2,127,559 | A | 8/1938 | Graf | |
| 2,282,571 | A | 5/1942 | Graf | |
| 2,456,065 | A | 12/1948 | Just | |
| 5,644,943 | A | 7/1997 | Lanz | |
| 8,214,934 | B2 * | 7/2012 | Sullivan | E03C 1/22 4/287 |
| 9,057,185 | B2 | 6/2015 | Childs et al. | |
| 9,243,393 | B1 | 1/2016 | Tidwell | |
| 9,783,968 | B2 | 10/2017 | Childs et al. | |
| 9,850,643 | B2 | 12/2017 | Eilmus et al. | |
| 9,863,129 | B2 * | 1/2018 | Lin | E03C 1/264 |

(Continued)

FOREIGN PATENT DOCUMENTS

| | | | |
|---|---|---|---|
| CA | 2784382 | A1 | 1/2014 |
| CN | 208105177 | U | 11/2018 |

(Continued)

*Primary Examiner* — Janie M Loeppke
(74) *Attorney, Agent, or Firm* — Husch Blackwell LLP

(57) ABSTRACT

A seamless drain system includes a sink basin having sidewalls and a bottom wall, and a seamless drain sidewall extending contiguously and below the bottom wall. The drain sidewall terminates in an attachment bayonet. The attachment bayonet includes an annular flange for removably coupling to a drainpipe adaptor or a disposal system. The sidewall includes a fluid line attachment stem for coupling a fluid line directly to the sidewall and drain. Accessories, such as a rubber splashguard or strainer basket, can be used in combination with a spray ring that nests within the drain sidewall and is in fluid communication with the fluid line, can be incorporated into the seamless drain system.

6 Claims, 30 Drawing Sheets

(56) References Cited

U.S. PATENT DOCUMENTS

| | | | |
|---|---|---|---|
| 10,119,256 | B1 | 11/2018 | Steffen et al. |
| 10,208,467 | B2 * | 2/2019 | Lin ..... E03C 1/262 |
| 10,519,637 | B2 | 12/2019 | Childs et al. |
| 10,626,586 | B2 | 4/2020 | Childs et al. |
| 10,920,405 | B1 | 2/2021 | Reidel et al. |
| 11,053,671 | B2 | 7/2021 | Childs et al. |
| 11,149,422 | B1 | 10/2021 | Just et al. |
| 11,208,794 | B2 | 12/2021 | Reidel et al. |
| 11,441,302 | B2 | 9/2022 | Reidel et al. |
| 11,549,247 | B2 | 1/2023 | Just et al. |
| 2014/0075662 | A1 | 3/2014 | Gayoso |
| 2016/0289934 | A1 | 10/2016 | Tidwell |
| 2017/0030059 | A1 | 2/2017 | Lin |
| 2020/0217054 | A1 | 7/2020 | Chen |
| 2022/0162839 | A1 | 5/2022 | Hofmeister |

FOREIGN PATENT DOCUMENTS

| | | | |
|---|---|---|---|
| CN | 215258451 | U | 12/2021 |
| CN | 114006569 | A | 2/2022 |
| CN | 215724544 | U | 2/2022 |
| CN | 216216656 | U | 4/2022 |
| CN | 114892757 | A | 8/2022 |
| CN | 218714442 | U | 3/2023 |
| EP | 3301233 | A1 | 4/2018 |
| EP | 3868965 | A1 | 8/2021 |
| WO | WO 2006053645 | | 5/2006 |
| WO | WO 2012135029 | A1 | 10/2012 |
| WO | WO 2014037413 | | 3/2014 |
| WO | WO 2016041636 | | 3/2016 |

* cited by examiner

SINK SYSTEM WITH SEAMLESS DRAIN AND ATTACHMENT BAYONET

RELATED APPLICATIONS

This application claims the benefit of U.S. Provisional Application Ser. No. 63/488,323, filed Mar. 3, 2023, which is incorporated herein by reference in its entirety.

TECHNICAL FIELD

The present disclosure relates generally to sinks and sink drains, and more particularly to edgeless or seamless sink drains with an attachment bayonet for quick attachment of a disposal system or drainpipe for use in retail, commercial, and industrial kitchen environments and the like.

BACKGROUND

Generally speaking, sinks are vessels configured for dispensing and draining water in a kitchen environment or washroom environment. A sink typically includes a faucet or other water-delivery device located proximate a basin of the sink, and a drainpipe is coupled to the basin via a drain formed in the bottom of the basin to remove unwanted water (e.g., wastewater). In some sinks, a disposal system, such as a garbage-disposal system, is coupled between the basin and the drainpipe. For instance, the disposal system can include a motorized grinding mechanism, such as a blade, housed within a chamber of the disposal system. The sink drain can also include appliances, such as rubber splashguards and strainers that fit within the sink drain.

A flange forming a seam is often present between a bottom wall of the basin and the drain, which can collect food, bacteria, debris, fungi and the like which can be difficult to keep clean. There remains a need for a cleaner and more sanitary drain environment.

SUMMARY

Examples of the present disclosure include a seamless drain system with an attachment bayonet including a fluid line inlet for utilizing a direct injection of a fluid, such as water or ozonated water.

In a non-limiting example, the seamless drain system includes a sink basin having sidewalls and a bottom wall, and a seamless drain extending contiguously and below the bottom wall. The drain includes an annular sidewall extending below the bottom wall, and an attachment bayonet at an end of the sidewall distal the bottom wall. The sidewall includes a fluid line attachment stem for coupling a fluid line directly to the sidewall and drain. The attachment bayonet includes an annular flange for removably coupling to a drainpipe adaptor or a disposal system.

In some examples, a duo-strainer assembly is removably positioned in the drain. The duo-strainer assembly includes a strainer basket with a stopper nested within a rubber or silicon collar. The collar includes a channel in fluid communication with the fluid line attachment stem, and the channel includes a plurality of openings. Upon introduction of fluid to the channel via the fluid line attachment stem, fluid is jetted into the drain and the strainer basket to clean the drain. Optionally, the fluid can comprise ozonated water.

In some examples, a rubber or silicon splashguard is removably positioned in the drain. The splashguard can include a plurality of inverted flanges, and a channel formed on an outer surface. The channel is configured to be in fluid communication with the fluid line attachment stem, and includes a plurality of openings. Upon introduction of fluid to the channel via the fluid line attachment stem, fluid is jetted into the drain and underneath the plurality of flanges to clean the drain. Optionally, the fluid can comprise ozonated water.

In some examples, an existing sink and drain assembly can be retrofitted with the drain and attachment bayonet assembly by bolting or otherwise securing the annular sidewall and attachment bayonet proximate the drain (seamless or not) of a sink basin.

The summary above is not intended to describe each illustrated embodiment or every implementation of the present disclosure. The figures and the detailed description that follow more particularly exemplify these embodiments.

BRIEF DESCRIPTION OF THE FIGURES

The disclosure will become more fully understood from the following detailed description, taken in conjunction with the accompanying figures, wherein like reference numerals refer to like elements, in which.

Figure 1:
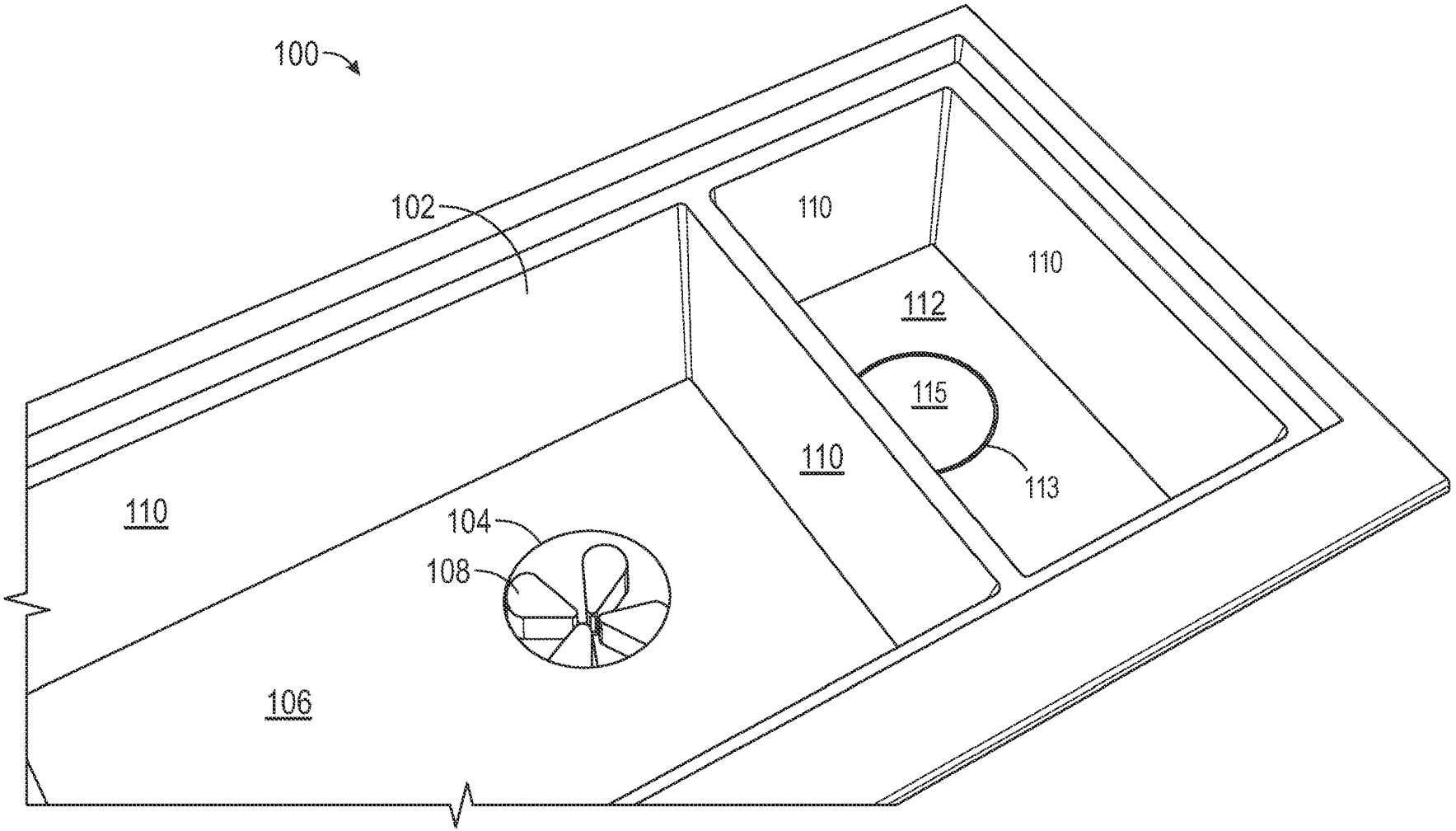
FIG. 1 is a top perspective view of a sink system with a seamless drain and splashguard.

While various examples are amenable to various modifications and alternative forms, specifics thereof have been shown by way of example in the drawings and will be described in detail. It should be understood, however, that the intention is not to limit the claimed inventions to the particular examples described. On the contrary, the intention is to cover all modifications, equivalents, and alternatives falling within the spirit and scope of the subject matter of the present disclosure.

DETAILED DESCRIPTION

Figure 2:
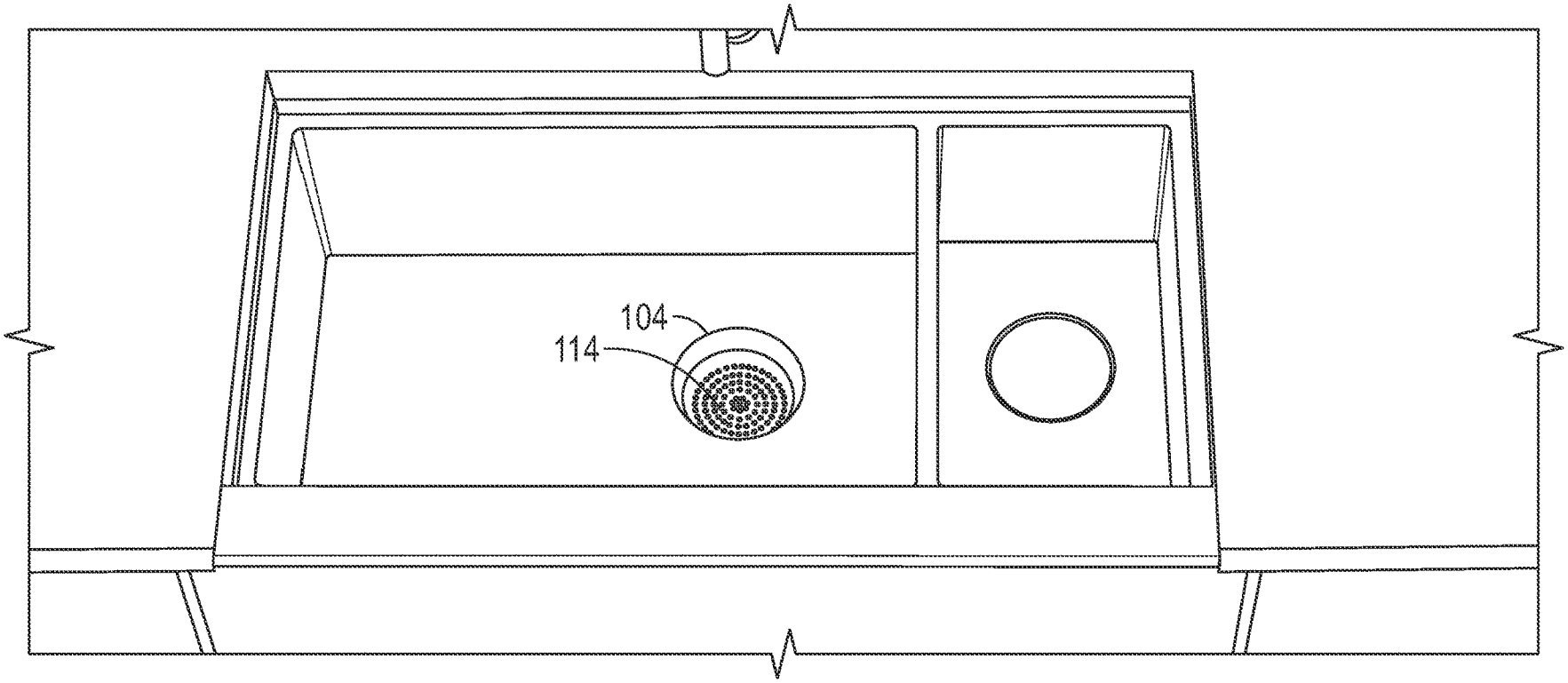
FIG. 2 is a top perspective view of a sink system with a seamless drain and strainer.

FIGS. 1 and 2 are perspective views of a sink system 100 that includes a sink basin 102 and a seamless drain collar 104 defining a drain formed in a bottom wall 106 of the sink basin 102. The sink system 100 can be a top mount sink in which the sink basin 102 is mounted to a top surface of a countertop, or a bottom mount sink in which the sink basin 102 mounts to a bottom surface of a countertop. In some non-limiting examples, the sink system 100 including the sink basin 102 and seamless drain 104 are formed from stainless steel, although other materials are also contemplated. The sink basin 102 may be fabricated to include an X-crease, or can be press-formed. The drain 104 can be sized to receive one or more of a splashguard, a drain cover, or a duo strainer assembly, which will be described in more detail infra.

The sink basin 102 generally includes a plurality of sidewalls 110 and the bottom wall 106. The sink system 100 can have a single basin 102 or can have multiple basins, such as a second basin 112, which in example, can be smaller, larger, or equal in size to the sink basin 102. Second basin 112 can also include a plurality of sidewalls 110, at least one of which is shared with sink basin 102. Second basin 112 can also include a seamless drain 113, which can be sized to receive one or more of a splashguard, a drain cover 115 (as shown), or a duo strainer assembly, described in more detail infra. The drain 113 can be smaller, larger, or equal in size to the drain 104.

In examples, the drain 104 is formed integrally and contiguously with the bottom wall 106 or welded thereto such that no seam is present between bottom wall 106 and drain 104. As depicted in FIG. 1, a splashguard 108, which will be described in more detail infra, can be removably positioned within the drain 104. As depicted in FIG. 2, a duo strainer assembly 114, which will also be described in more detail infra, can be removably positioned within the drain 104.

The sink basin 102 may be configured to receive a material (e.g., fluid, waste, food, etc.) and can include a faucet. The faucet may be positioned proximate the sink basin 102. By way of example, a user can actuate the faucet between an "on" position and an "off" position such that the faucet selectively outputs material. The sink basin(s) may be configured to receive a flow of fluid and/or waste, and delivering the flow to a drainage outlet via the drain 104. In some examples, the drain 104 may be fluidly coupled to a disposal system. For example, the drain 104 may be fluidly coupled with at least one of the inlets of the disposal system, and can include, for example, a direct-inject waste-disposal unit configured to dispose of food or other kitchen waste, according to some examples.

Figure 3:
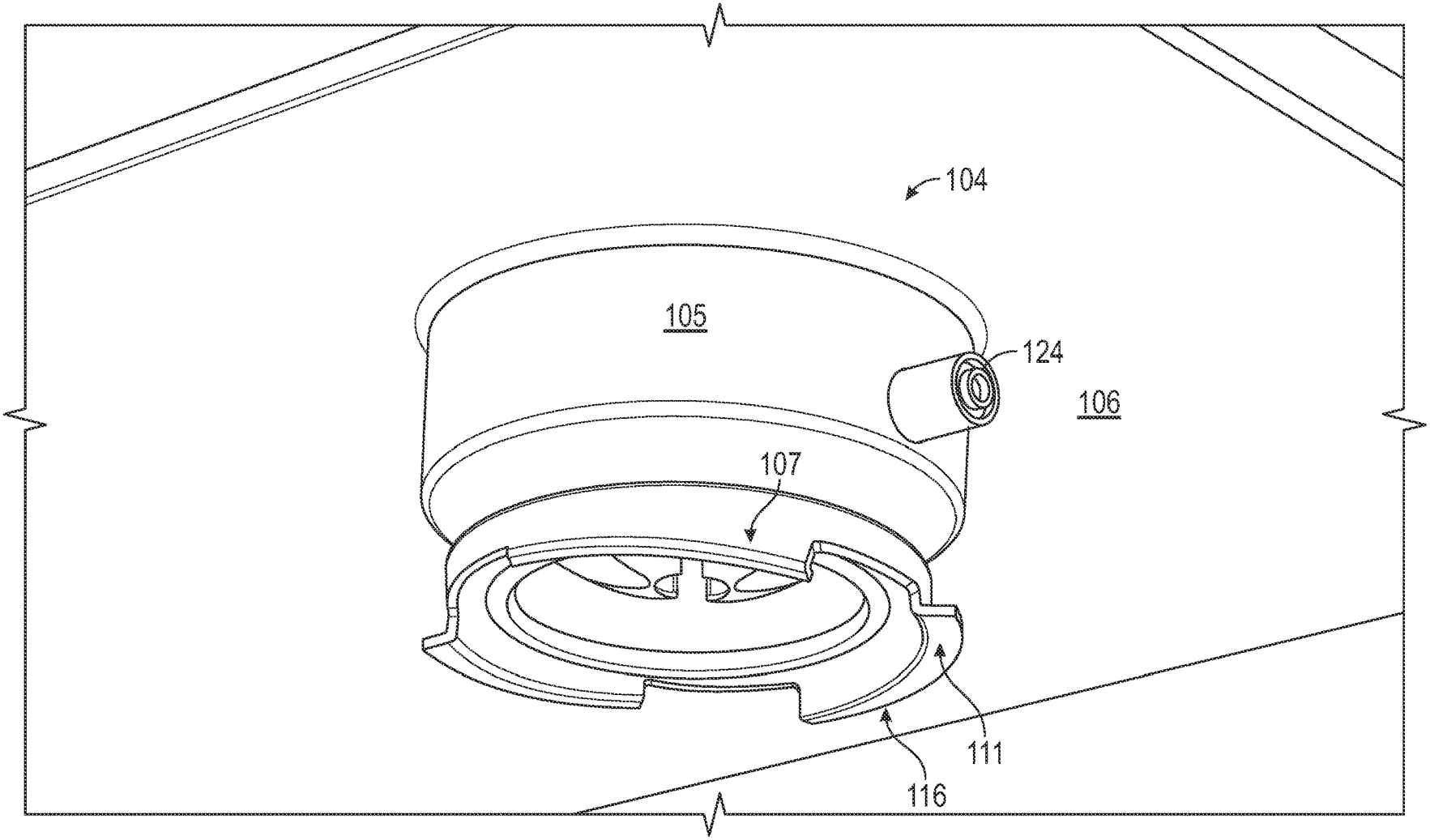
FIG. 3 is a bottom perspective view of a drain of the sink system with attachment bayonet and fluid inlet.
Figure 4:
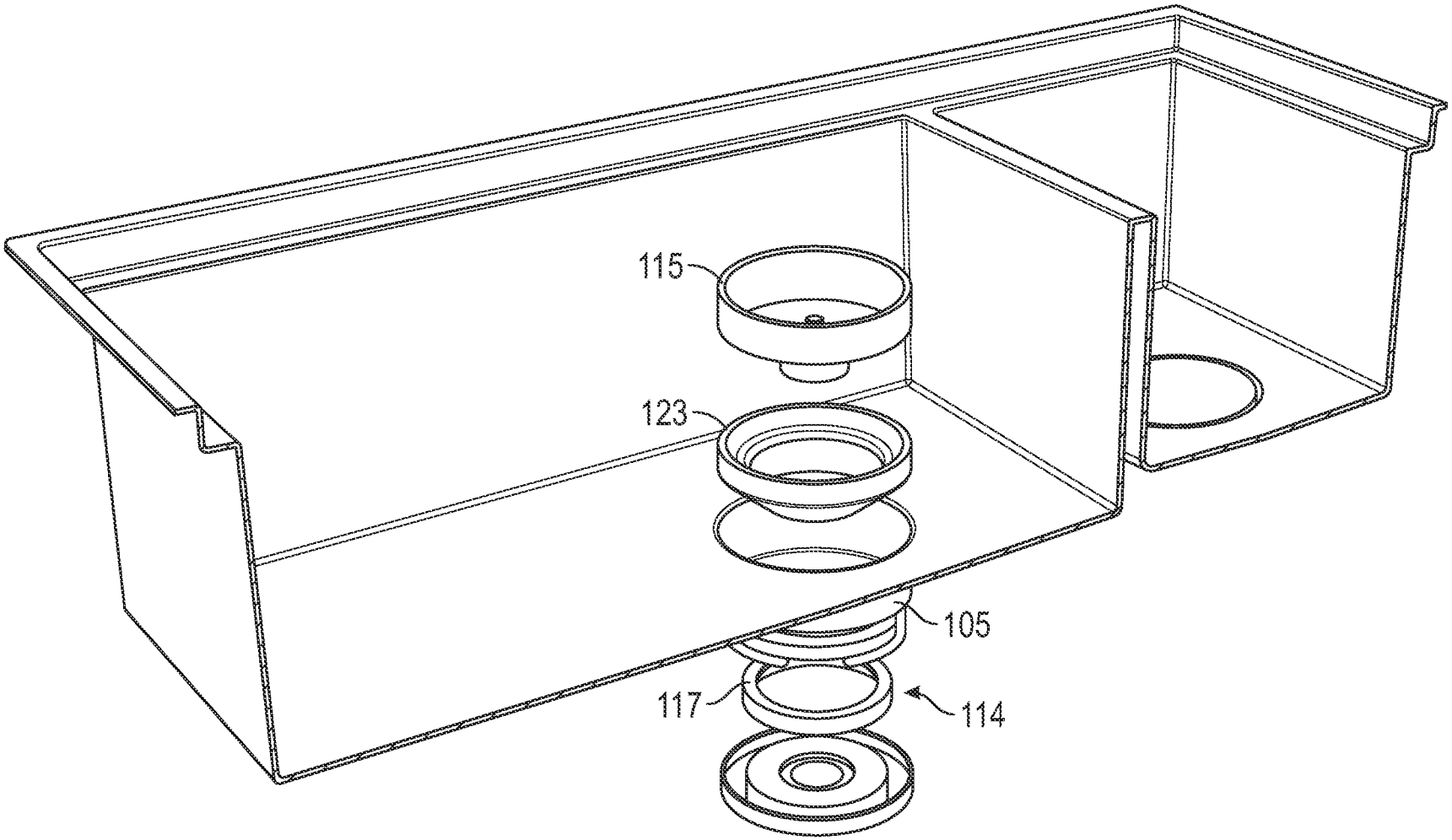
FIG. 4 is an exploded view of a sink system with seamless drain and duo strainer assembly.

Referring now to FIG. 3, the drain 104 includes a collar having an annular sidewall 105 contiguous with and extending below the bottom wall 106 to form a drainage outlet at a distal end 107 of the sidewall 105. The sidewall 105 terminates as structure defining an attachment bayonet 111 welded to or otherwise coupled to the distal end 107 of the sidewall 105. In an example, the attachment bayonet 111 is permanently coupled to the distal end 107 such as by welding. In another example, the attachment bayonet 111 is removably coupled to the distal end 107 such that the attachment bayonet 111 can be removed and replaced with a differently shaped bayonet to provide a different coupling mechanism, or can be replaced with a new attachment bayonet 111 for purposes of repair.

Figure 12:
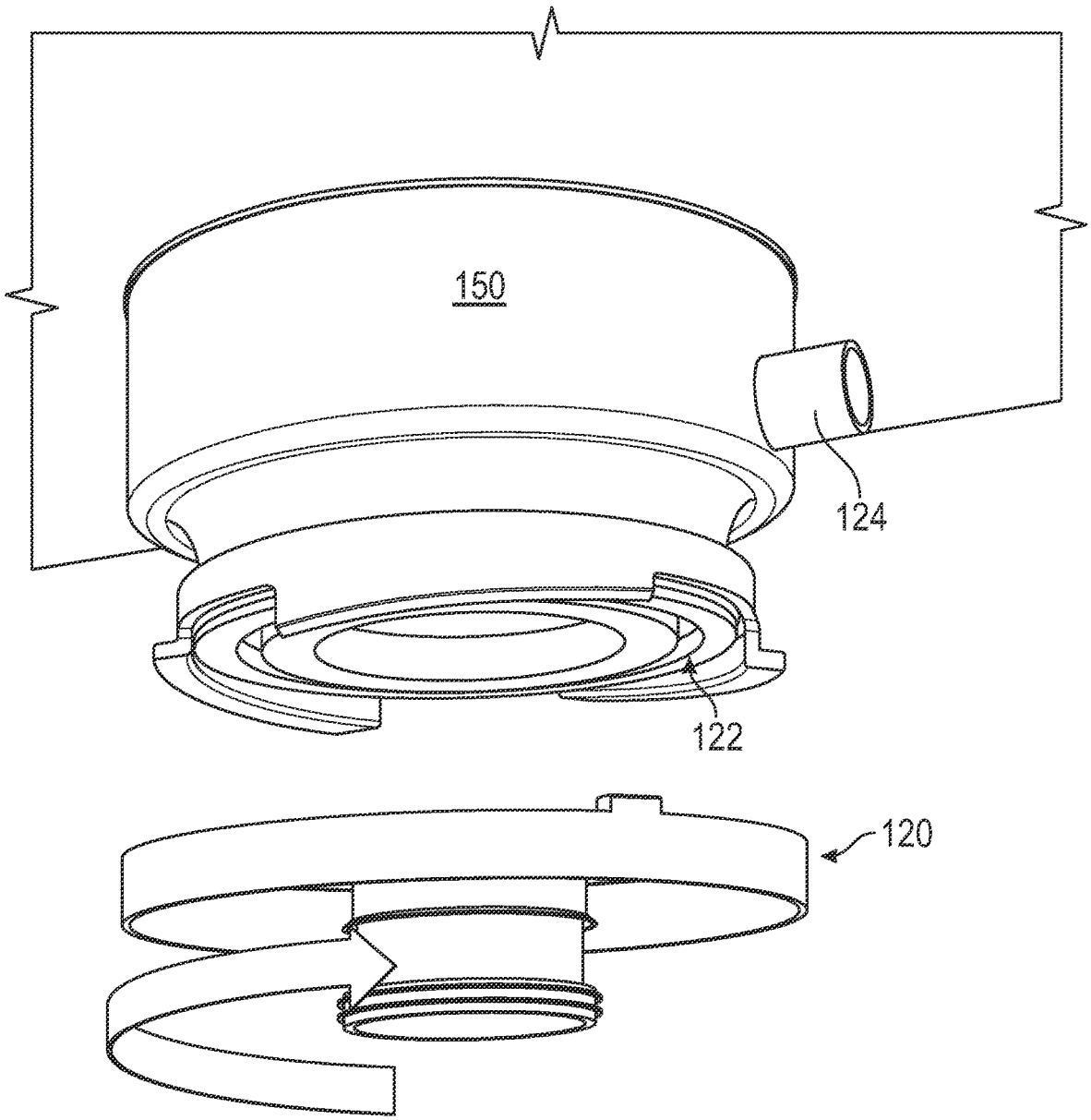
FIG. 12 is a bottom view of a drain of the sink system with attachment bayonet and drain pipe adaptor.

In examples, the attachment bayonet 111 can be structured for removably coupling to a drainpipe via a drain adapter or can be coupled to a disposal system. The attachment bayonet 111 is structured such that a drainpipe adapter or a disposal system can be easily swapped out for each other, without the need for replacing the entire sink. In examples, and as depicted in FIG. 3, the attachment bayonet 111 includes an annular flange 116 configured to engage with corresponding tabs 119 on a drainpipe adapter 120 (see, e.g., FIGS. 7 and 12) or disposal system or by twisting the disposal system or drainpipe adapter 120 with respect to the attachment bayonet 111 so as to lock the disposal system or drainpipe adapter 120 to the flange 116.

The sidewall 105 can further comprise a fluid line inlet stem 124 for connecting, such as by threaded engagement, press fit, a fluid line to the drain 104. The fluid line inlet stem 124 allows for direction injection of a fluid, such as water, ozonated water, a cleaning solution, or a combination thereof, from a separate fluid source than the faucet, into the drain 104, which will be described in more detail infra. Optionally, an ozone generator can be placed in the water line to generate ozonated water.

Figure 5:
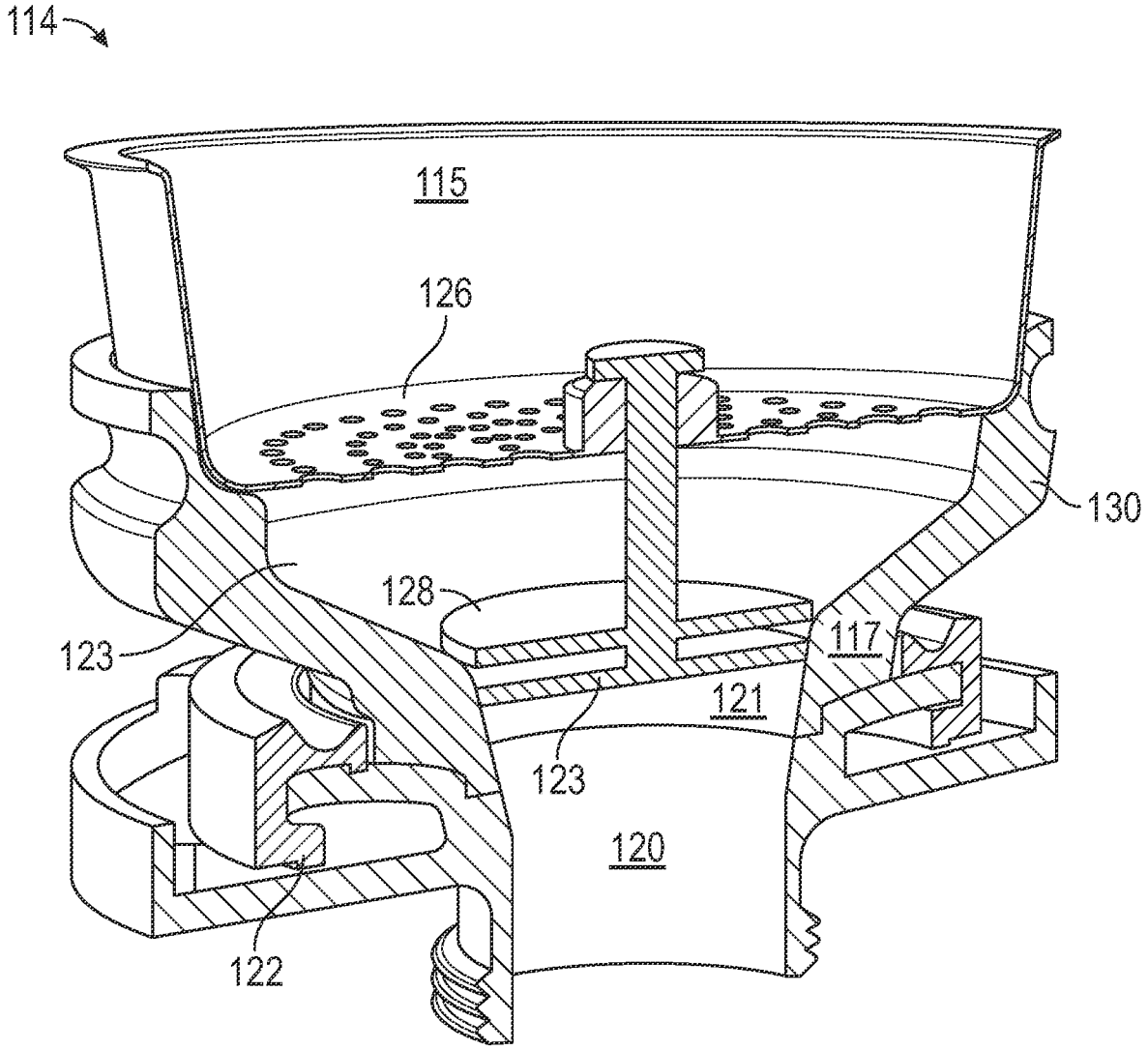
FIG. 5 is an assembled view of the sink system with seamless drain and duo strainer assembly of FIG. 4.
Figure 6:
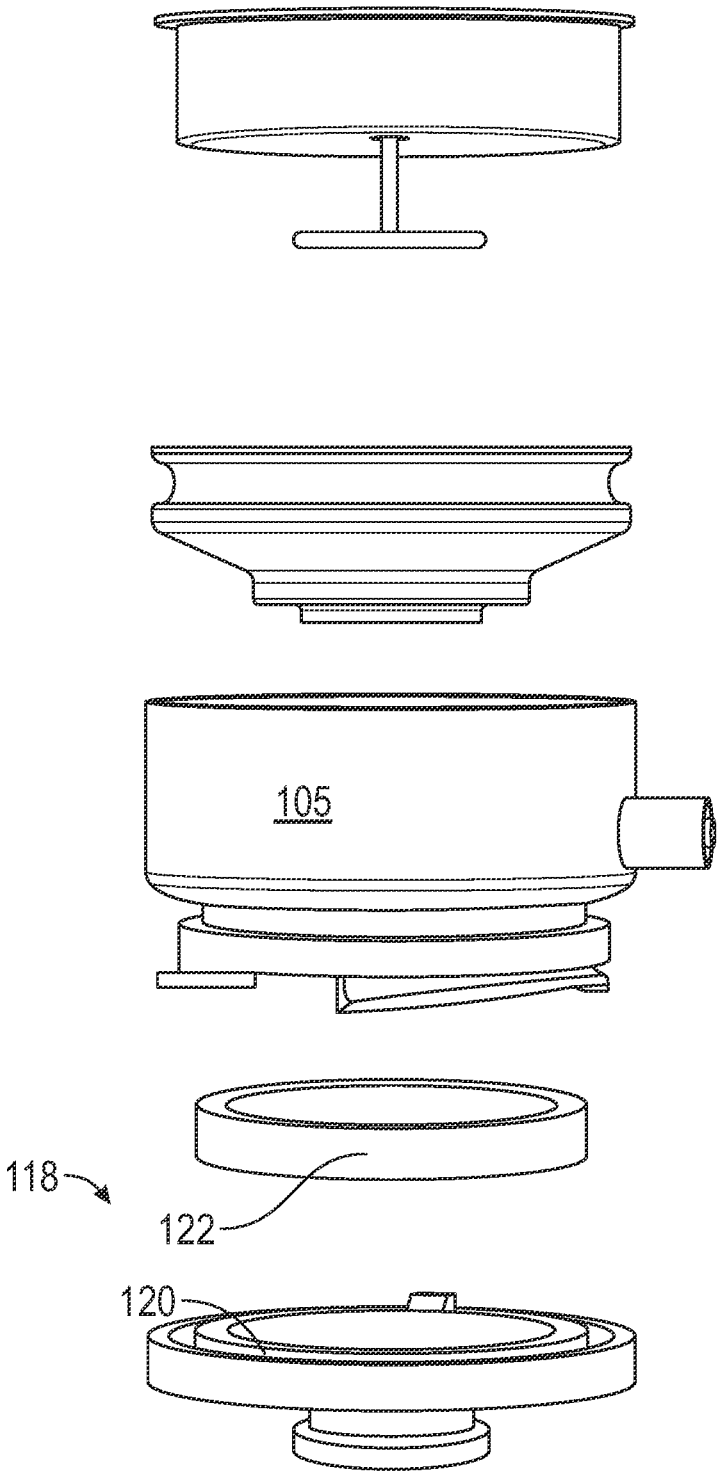
FIG. 6 is a front exploded view of a sink system with seamless drain and duo strainer assembly of FIG. 4.

Referring now to FIGS. 4-6 and 11, in some examples, a duo strainer assembly 114 may be coupled or positioned within sidewall 105 of drain 104. The duo strainer assembly 114 may include a strainer or basket 115 with stopper 123, and a rubber collar 117, as depicted. As depicted in FIG. 5, strainer 115 is partially nested within the collar 117, and can include a first strainer surface 126 and a second strainer surface 128 below the first strainer surface 126. The second strainer surface 128 can have smaller straining holes formed therein than the first strainer surface 126 to catch any solid material that has passed through the first strainer surface 126. The second strainer surface 128 also includes a stopper 123 configured to fit within a bottom neck 121 of rubber collar 117 for stopping the flow of fluid through the drain 104.

Figure 11:
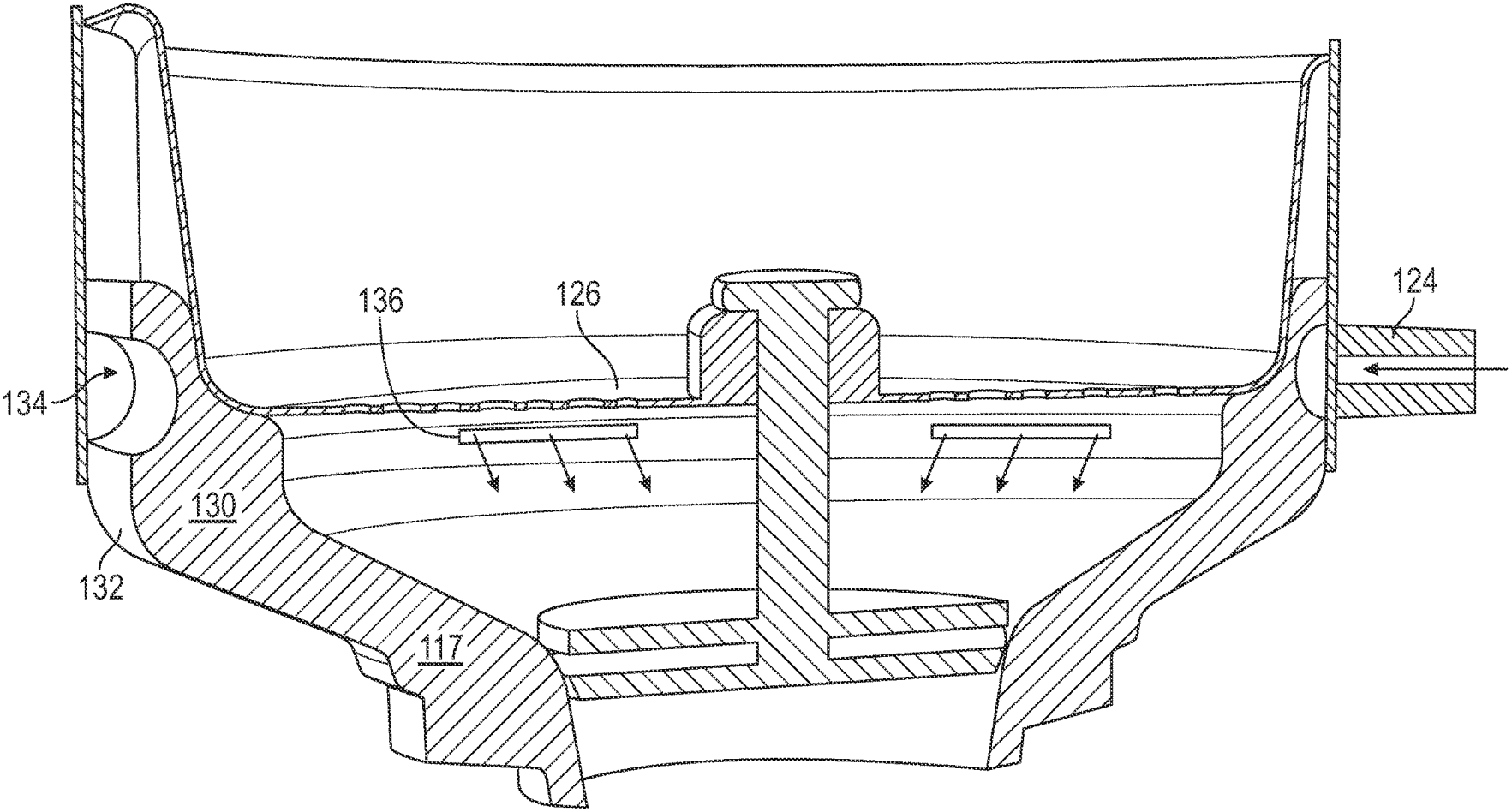
FIG. 11 is a perspective view of a duo strainer assembly for use with direct injection.

Referring now to FIGS. 5 and 11, the rubber collar 117 of the duo strainer assembly 114, the collar 117 includes an internal shoulder 130 on which the basket 115 is configured to nest when assembled. The collar 117 then tapers from a first end to a second end such that the second end can be secured to a drainpipe adaptor 120. An outer surface 132 proximate the shoulder 130 includes structure defining a channel 134, the channel 134 including a plurality of openings 136 or jets. The channel 134 is in fluid communication with the fluid line inlet stem 124. When fluid is introduced into the stem 124, the fluid flows through the channel 134 and is injected into the collar 117 and underneath the first strainer surface 126 for cleaning, rinsing, or otherwise sanitizing the assembly 114.

Referring to FIGS. 4-6 and 12, in examples, an attachment hardware in the form of a drain adapter assembly 118 including a drainpipe adapter 120 and a seal or gasket 122 may by be incorporated or otherwise attached such that the geometry may be adapted for drainpipe installations. In examples, the drainpipe adapter 120, may be readably affixed to the attachment bayonet (e.g., rotatably, clipped, or otherwise connected), in which more easily affixes to a drainpipe.

Figure 7:
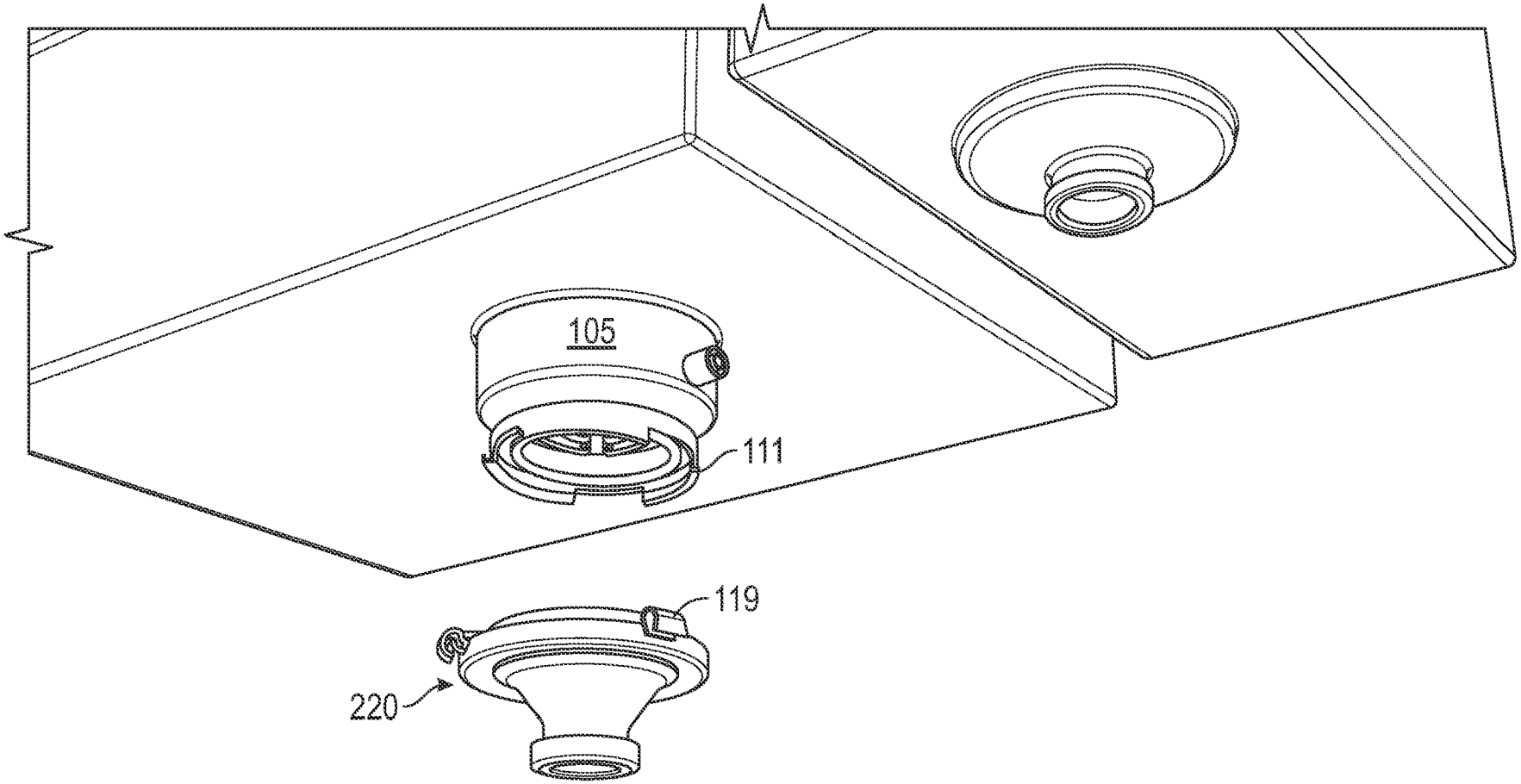
FIG. 7 is a bottom perspective view of a sink system with rubber splashguard and drainpipe adaptor.
Figure 8:
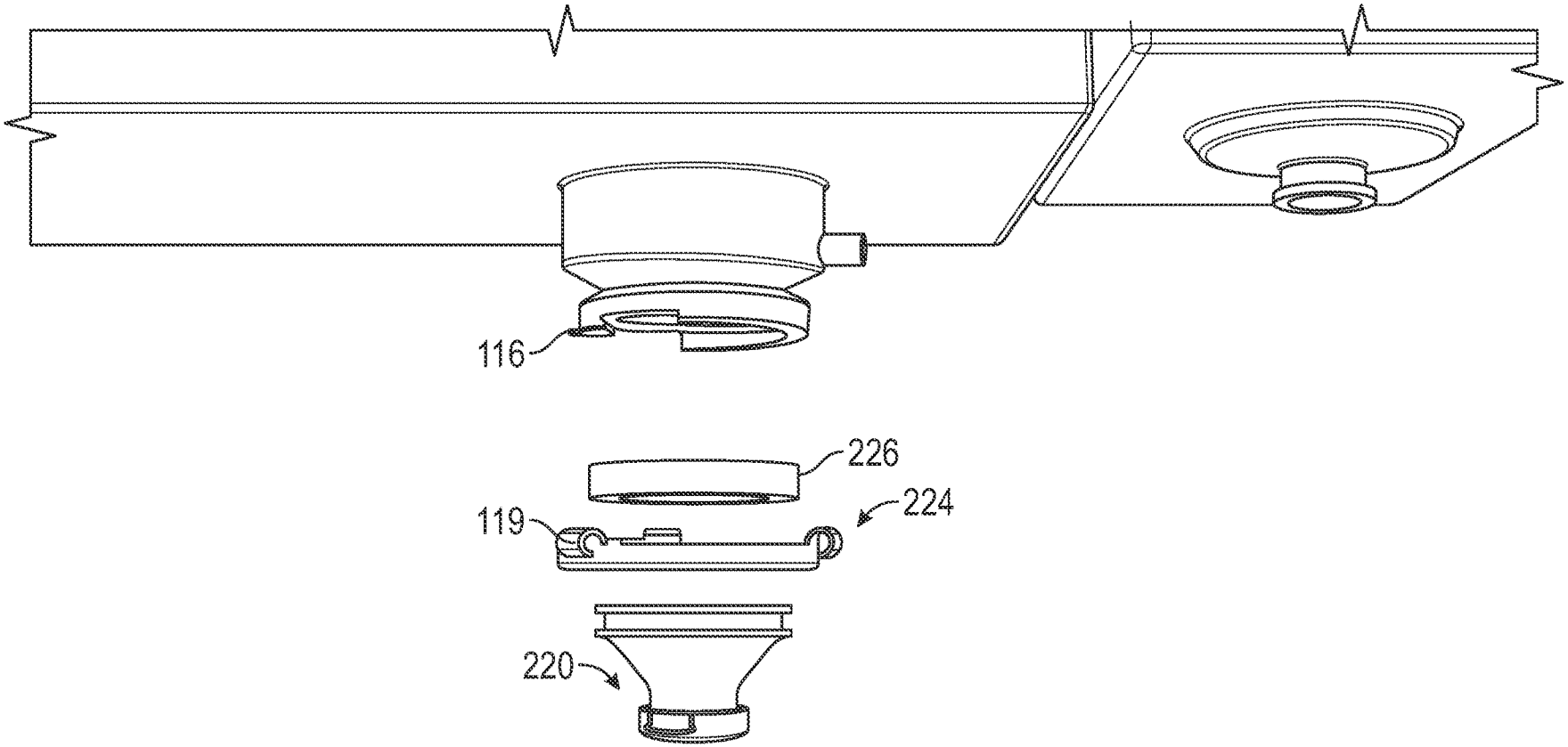
FIG. 8 is an exploded view of the sink system with rubber splashguard and drainpipe adaptor of FIG. 7.

In other examples, referring to FIGS. 7 and 8, a tapered drainpipe adapter 220 may be configured with a drainage radius transitioning from a first radius, such as approximately one inch to a second radius smaller than a first radius, such as approximately a half inch. The drainpipe adapter 220 is removable coupled to the attachment bayonet 111 via attachment hardware 224 and a rubber seal 226. The attachment hardware 224 includes tabs 119 for engaging the flange 116 of the attachment bayonet 111.

Figure 9:
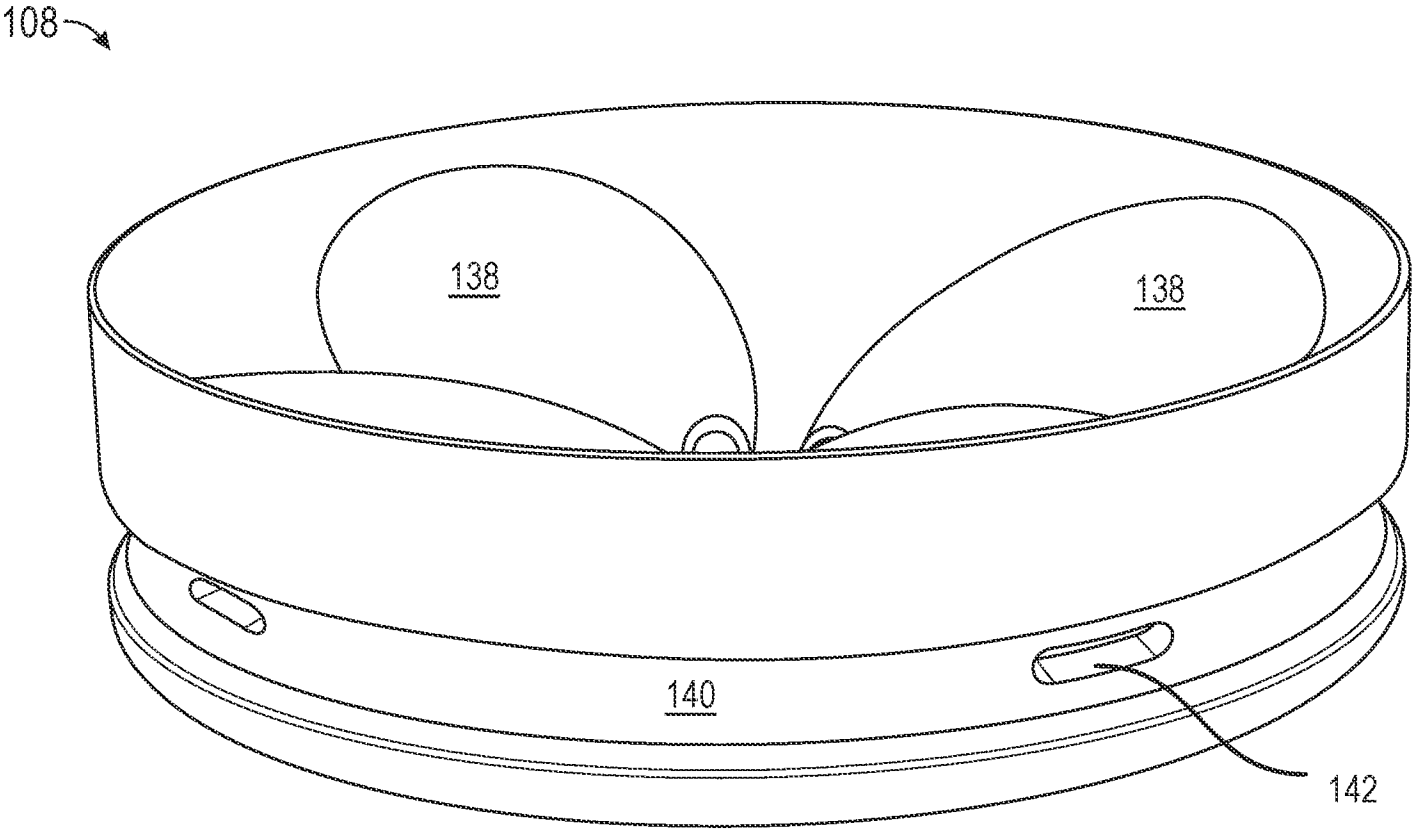
FIG. 9 is a perspective view of a rubber splashguard for use with direct injection.
Figure 10:
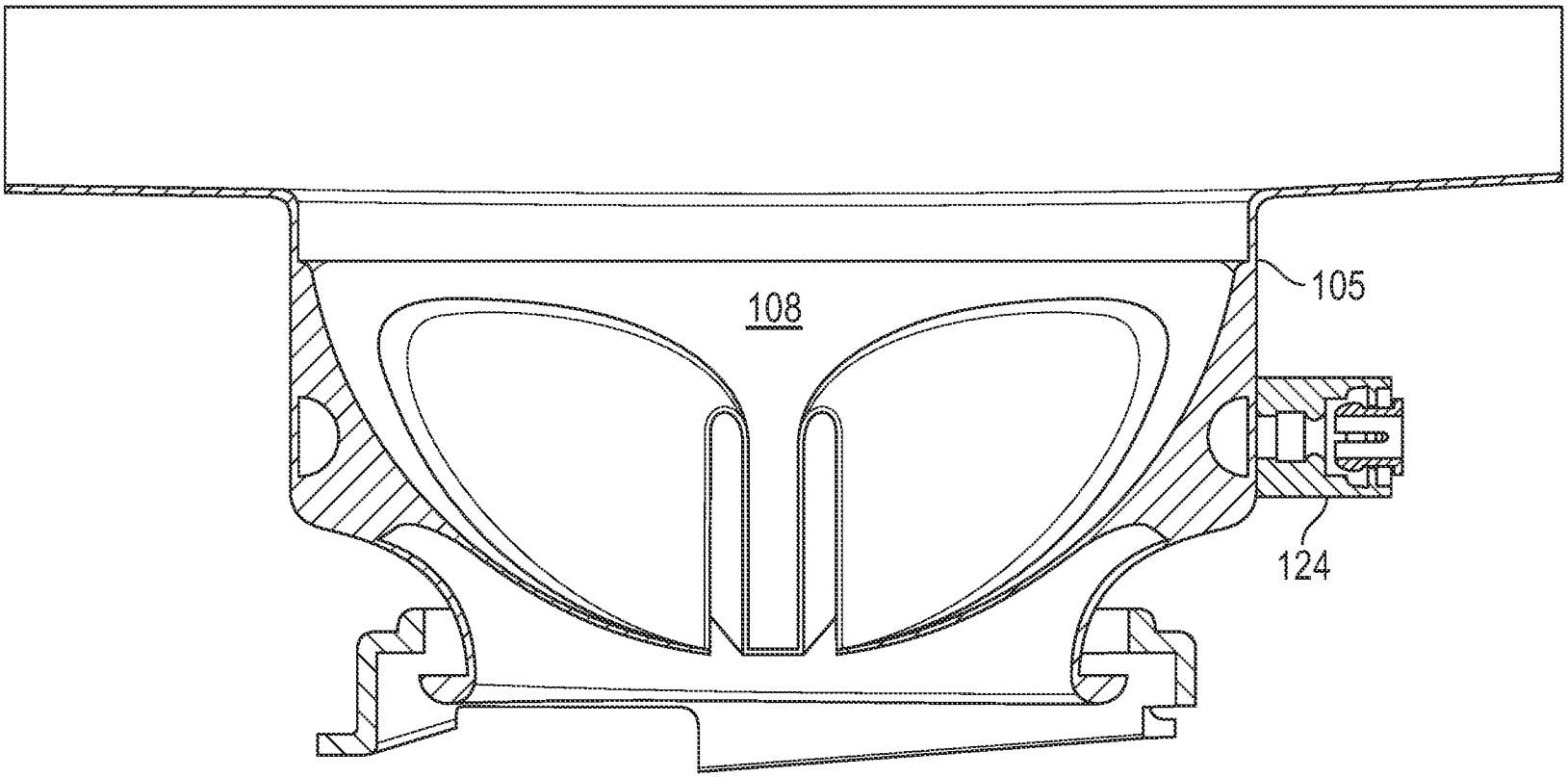
FIG. 10 is a front view of the rubber splashguard of FIG. 9 in a seamless drain sink system.

Referring now to FIGS. 9 and 10, in examples, a rubber or silicone splashguard 108 may include one or more inverted drainage flanges or petals 138 configured to disperse said flow of fluid to an underside of the splashguard 108. In examples, an outer surface of splashguard 108 can include structure defining a channel 140 that is configured to be in fluid communication with the fluid inlet stem 124. The channel 140 includes one or more openings or jets 142 configured to disperse the fluid introduced from the fluid inlet stem through the drainage flanges 138 for cleaning and sanitizing the underside of the splashguard 108. In examples, the direct injection of fluid to the splashguard may be configured to clean, rinse, or otherwise sanitize the internal structures of the drain environment of the drain 104. In some examples, fluid flow through the fluid inlet stem 124 may be conducted automatically with the activation of a disposal system (i.e., without requiring the flow of liquid from the faucet), automatically via a digital valve, or manually via activation of the button, switch, or other actuator. An example of a direct inject disposal system that can be combined with the systems described in the instant application is described in U.S. patent application Ser. No. 18/531,649, filed Dec. 6, 2023, which is hereby incorporated by reference in its entirety.

Figure 13:
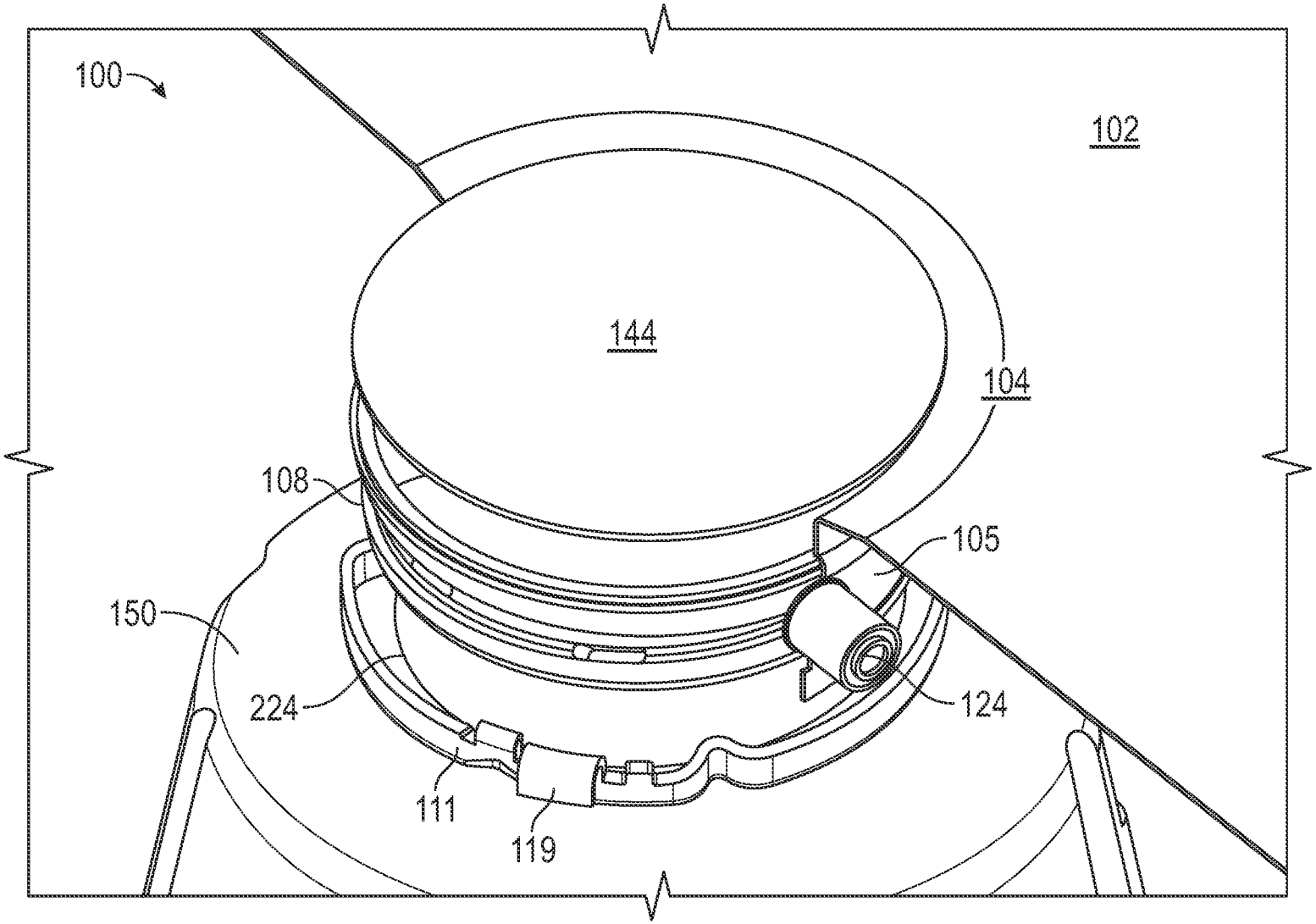
FIG. 13 is a top perspective cutaway view of a seamless drain sink system and splashguard with a disposal coupled thereto and an optional cover accessory.
Figure 14:
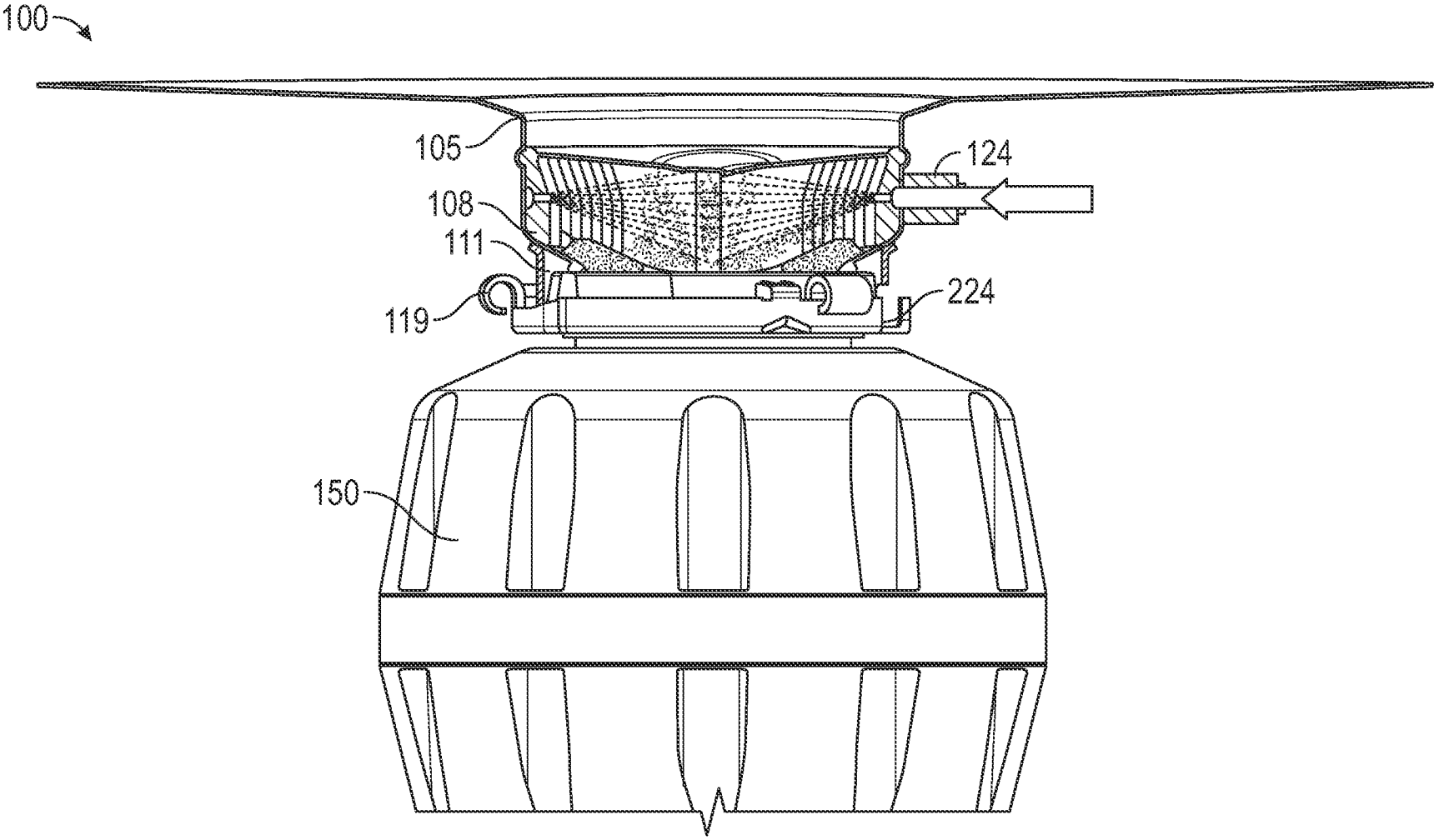
FIG. 14 is a front elevational view of the system of FIG. 13.
Figure 15:
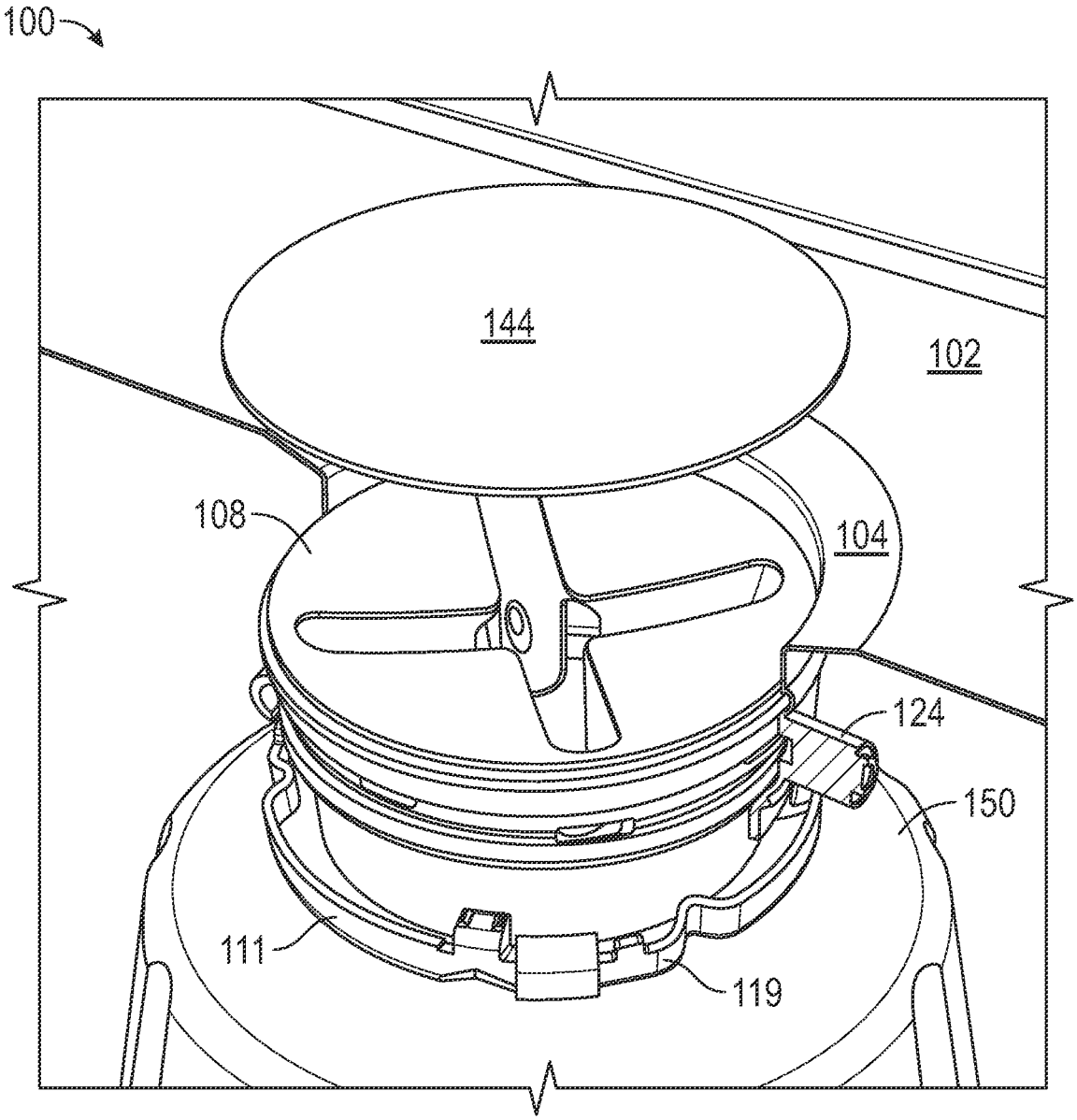
FIG. 15 is a top perspective cutaway view of the system of FIG. 13 with the cover accessory lifted.

Referring now to FIGS. 13-15, in examples, a sink system 100 includes a sink basin 102 with seamless drain 104, attachment bayonet 111, and removable cover accessory 144. Similar to FIGS. 9 and 10, a splashguard 108 is nested within drain collar 104. In this example, a disposal system 150 is coupled via attachment hardware 224 with tabs 119 for engaging the flange 116 of the attachment bayonet 111. The disposal system 150 can be coupled to the attachment hardware via a threaded engagement, in a non-limiting example, in which threads formed on an outer surface of the collar of the disposal system 150 engage threads (not shown) formed on an internal surface of the attachment hardware 224. As depicted in FIG. 14, water, ozonated water, or other sanitizing or cleaning fluid is directly injected into the splashguard 108 via the inlet stem 124.

Figure 16:
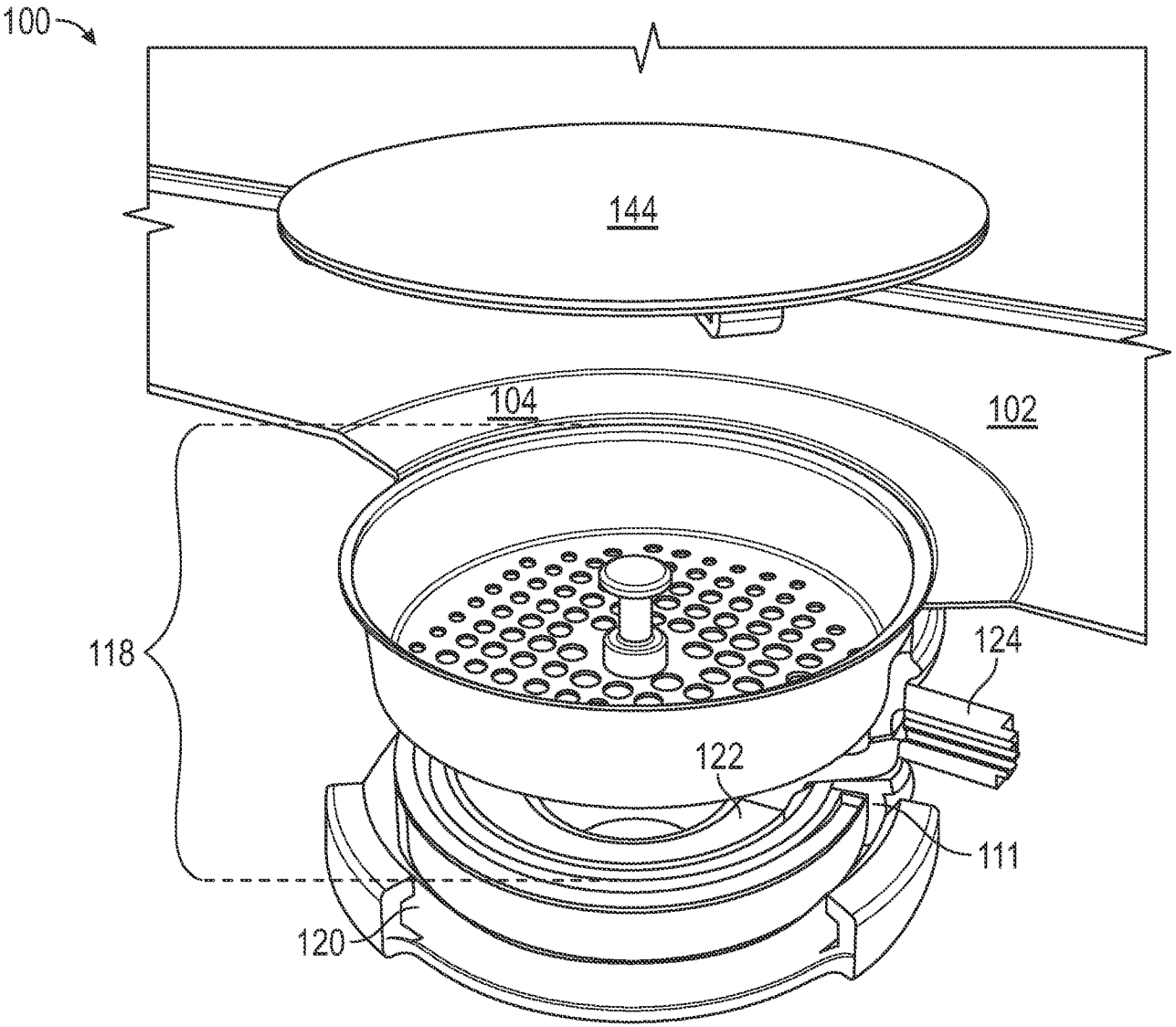
FIG. 16 is a top perspective cutaway view of a seamless drain sink system with a duo strainer assembly and an optional cover accessory.

Referring now to FIG. 16, a sink system 100 includes a sink basin 102 with seamless drain 104, attachment bayonet 111, and removable cover accessory 144. Instead of the splashguard and disposal system of the example of FIGS. 13-15, the duo strainer assembly 114, described previously with respect to FIGS. 4-6 can be nested within drain 104. The drain adapter assembly 118 with drainpipe adapter 120 and gasket 122 are depicted coupled thereto.

Figure 17:
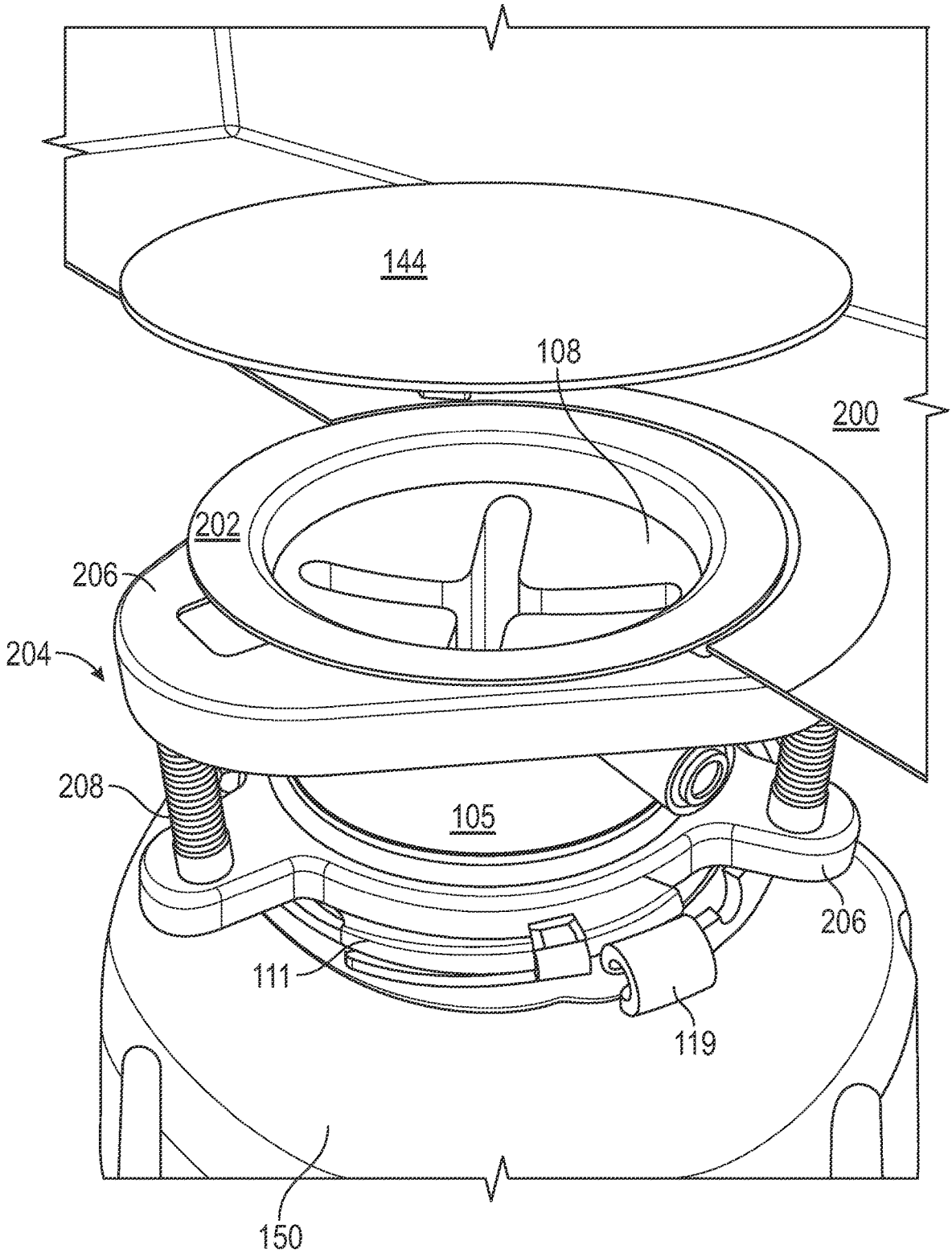
FIG. 17 is a top perspective cutaway view of a retrofitted sink system and splashguard with a disposal coupled thereto and an optional cover accessory.

Referring now to FIG. 17, a sink 200 having a traditional drain 202 (i.e., not seamless), can be retrofitted with a drain assembly 204, including the sidewall 105 with the fluid line inlet stem 124, and attachment bayonet 111, as previously described. Drain assembly 204 can be coupled to a bottom surface of the sink 200 via brackets 206 and adjustable fasteners 208. Although threaded bolts 208 are depicted, other mechanical fasteners can also be considered. In this example, a disposal system 150 is coupled to attachment bayonet 111 via attachment hardware with tabs 119 for engaging the flange 116 of the attachment bayonet 111. However, it can also be contemplated that a duo strainer assembly with drain adaptor as previously described can be substituted for the disposal system 150 and splashguard 108.

Referring now to FIGS. 18A-18D, another example of a splashguard assembly 300 for use in the seamless drain sink 100 as described above with a garbage disposal system attached thereto (not shown) is depicted. It is understood that this splashguard assembly 300 can be used in other sinks, with or without disposal systems, as well. In this example, a rubber splashguard 302 includes a plurality of inverted petals 304 as described supra, and rigid ring 306, such as a hard plastic ring, is embedded within the sidewall of the rubber splashguard 302. A spray ring 308 including a fluid channel 310 and apertures 312 forming jets nests within an annular channel 314 of the sidewall 105 of the drain 104. The splashguard 302 nests within the drain 104 and the spray ring 308. An annular ledge 316 formed on an outer surface of splashguard 302 abuts the upper surface of channel 310 of the spray ring 308.

Figure 18A:
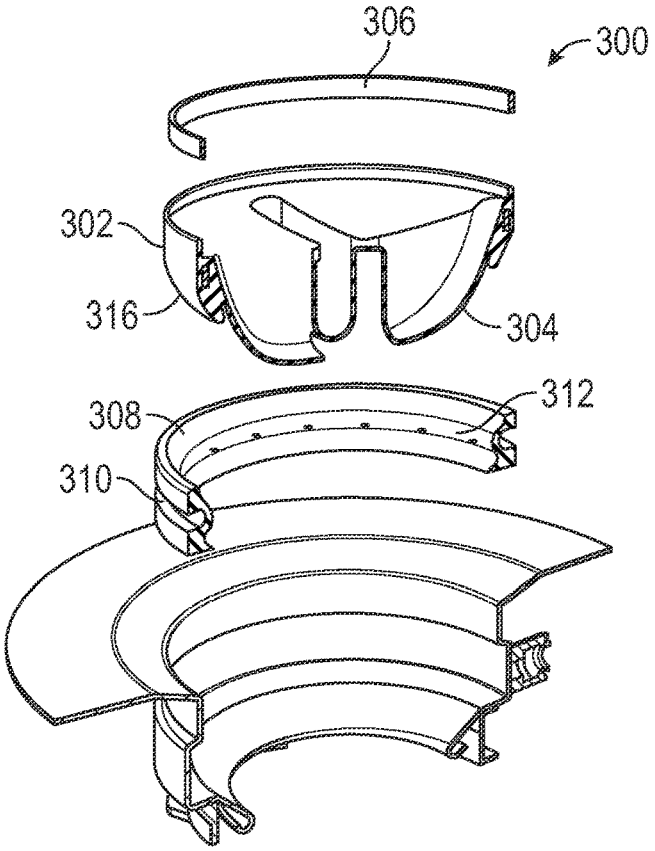
FIG. 18A is an exploded cutaway view of a splashguard assembly.
Figure 18B:
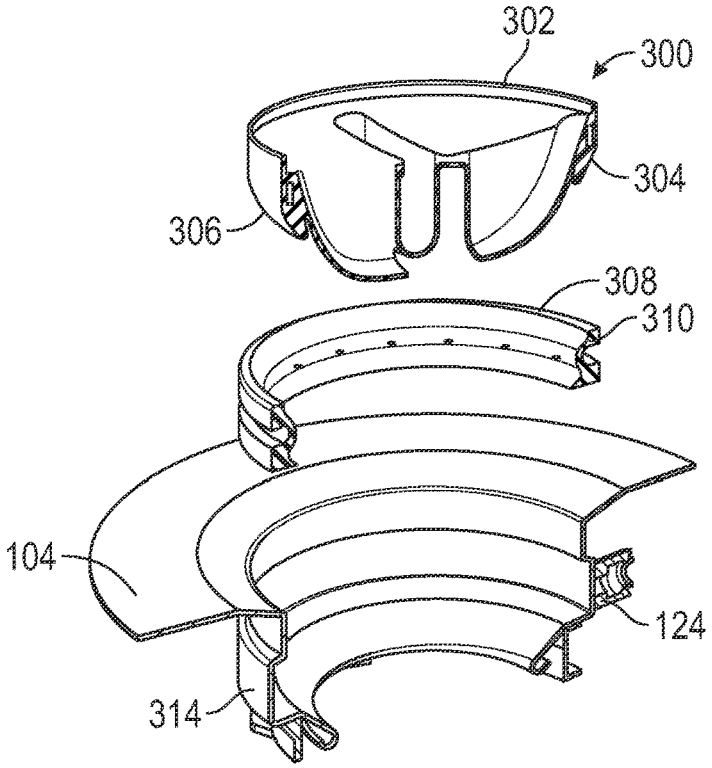
FIG. 18B is another exploded cutaway view of a splashguard assembly.
Figure 18C:
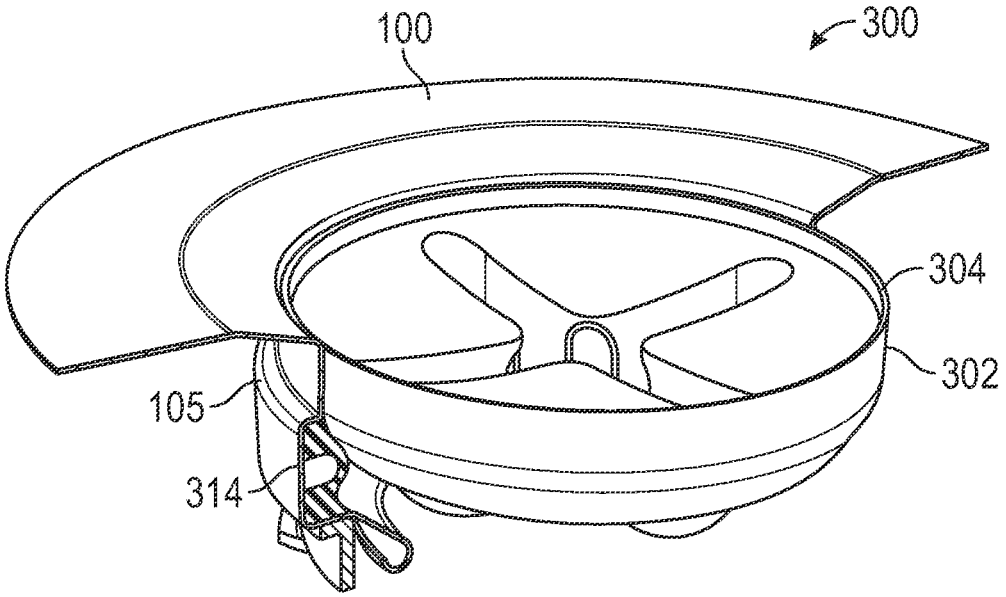
FIG. 18C is a partial cutaway perspective view of a splashguard assembly.
Figure 18D:
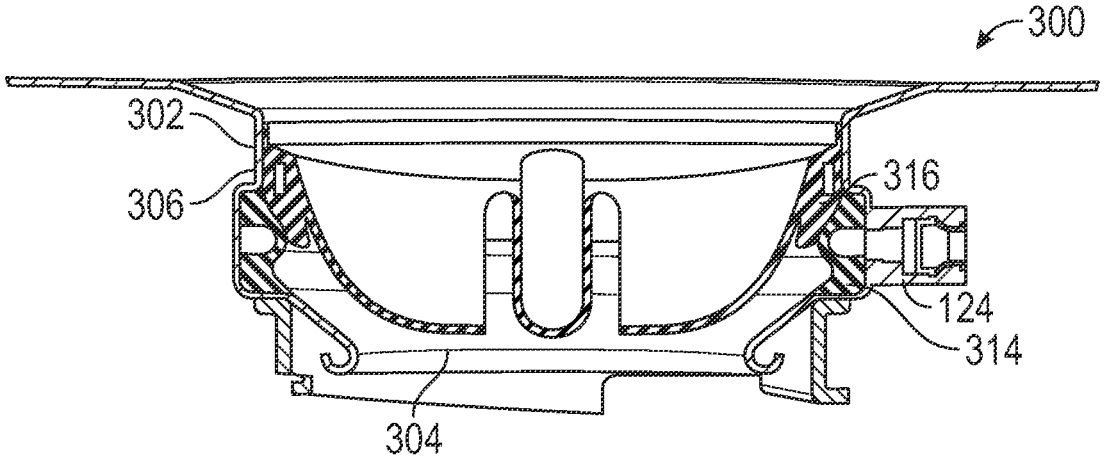
FIG. 18D is a side cutaway view of a splashguard assembly.
Figure 19:
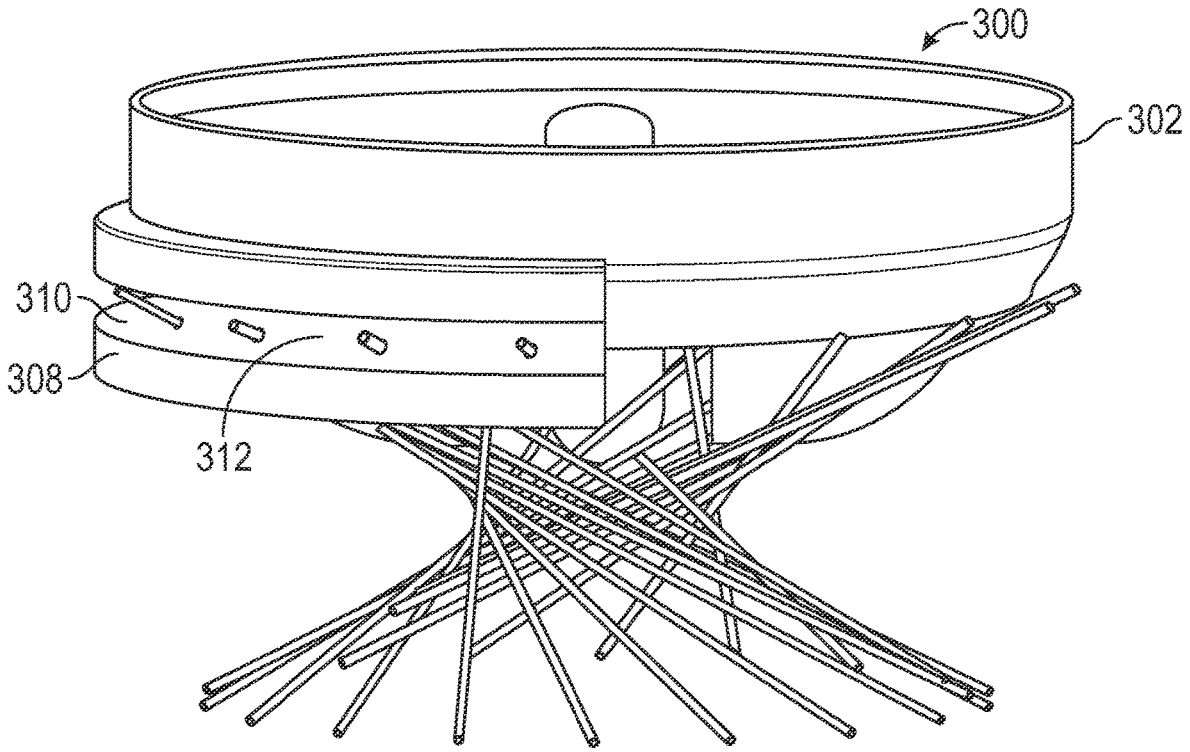
FIG. 19 is a perspective view of a splashguard assembly.
Figure 20A:
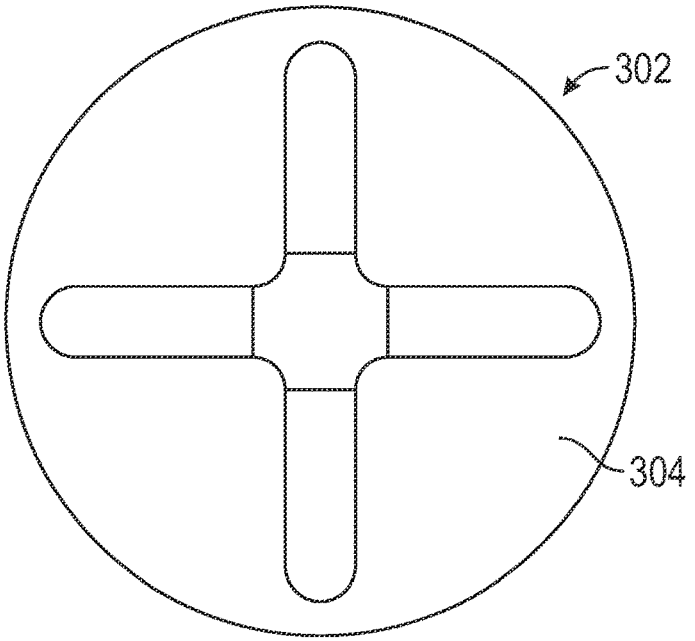
FIG. 20A is a top view of a portion of a splashguard.
Figure 20B:
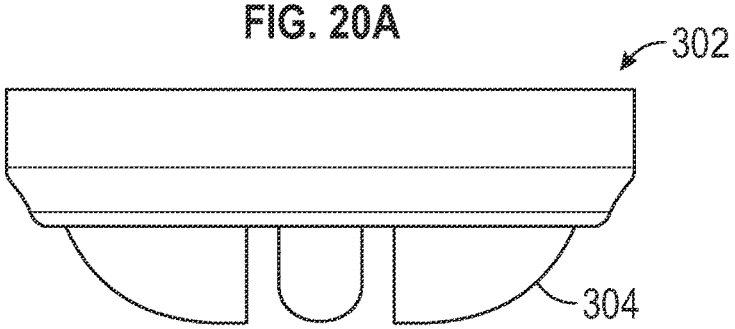
FIG. 20B is a side view of FIG. 20A.
Figure 20C:
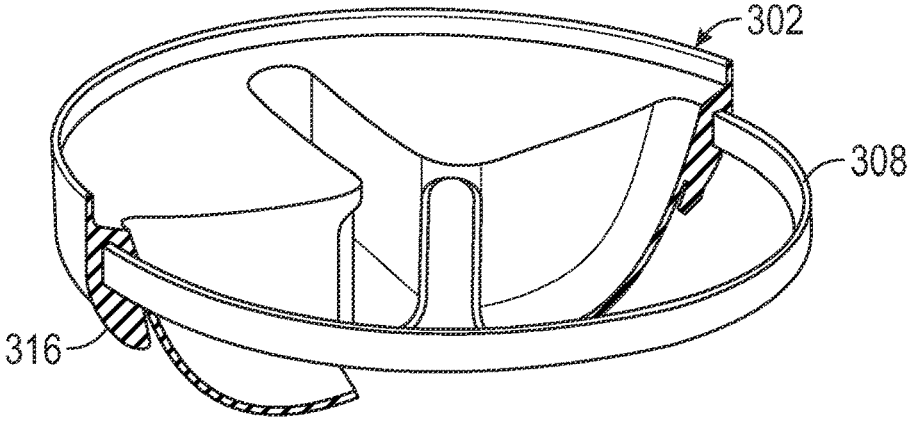
FIG. 20C is a partial cutaway perspective view of FIG. 20A.
Figure 21:
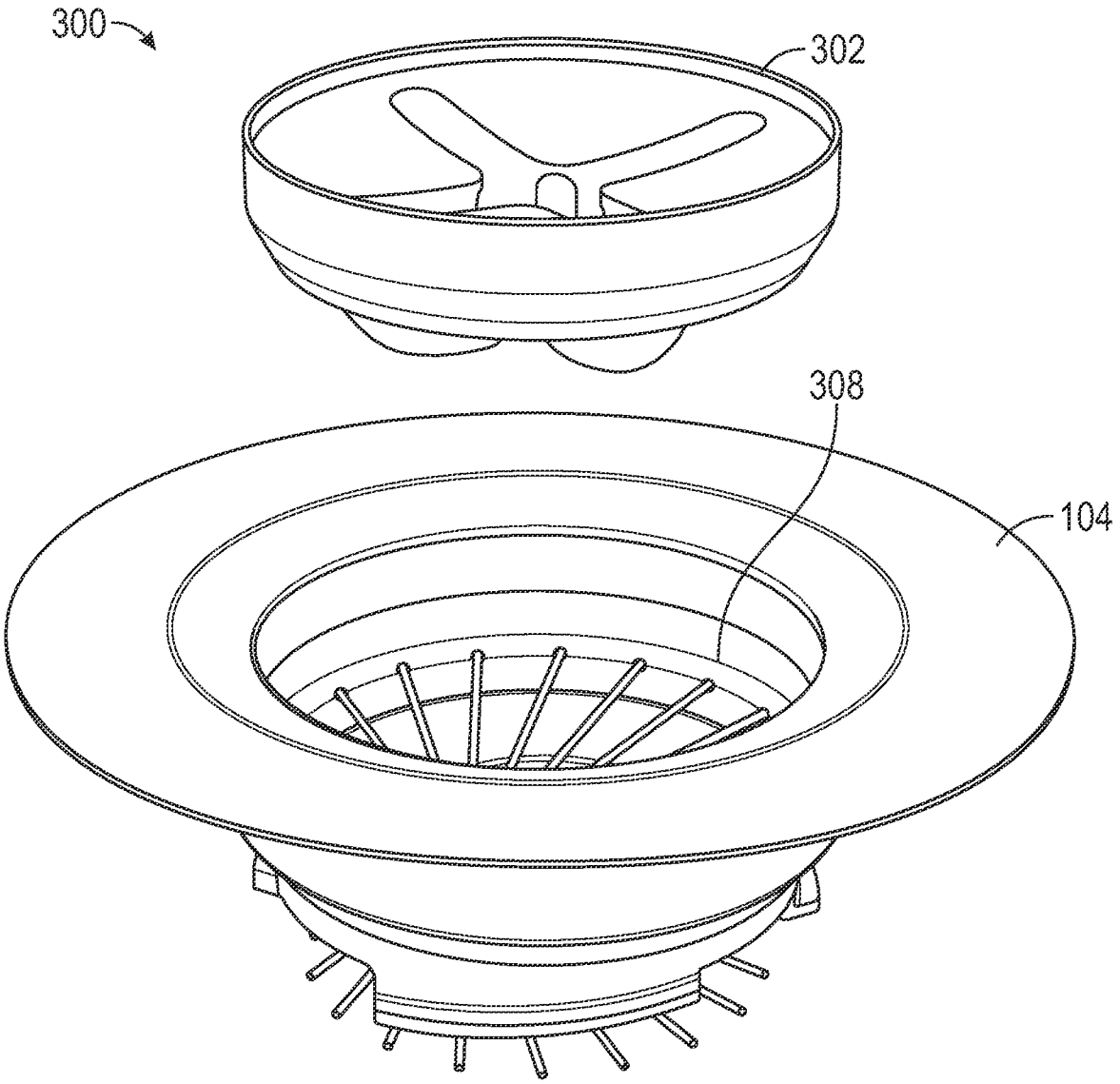
FIG. 21 is an exploded perspective view of a splashguard and a drain.

Referring now to FIGS. 19 and 20A-20C, in use, the splashguard assembly allows for fluid to enter the channel 314 from the fluid inlet 124 of drain 104 (FIG. 18D). This fluid can be clean, gray, or filtered water, with an optional additive such as soap or a sanitizing additive, ozonated water, or similar sanitizing or cleaning additive. The fluid enters the channel 310 of the spray ring 308 and is forced through the apertures 312 as a plurality of jets entering under the splashguard 302 for rinsing, cleaning, or sanitizing under the splashguard 302 and in the drain 104 and entry into the disposal system if coupled to the drain 104. Referring to FIG. 21, the splashguard 302 can optionally be removed from the drain 104 in order for a user to see the fluid entering the drain 104 through the spray ring 308.

Figure 22:
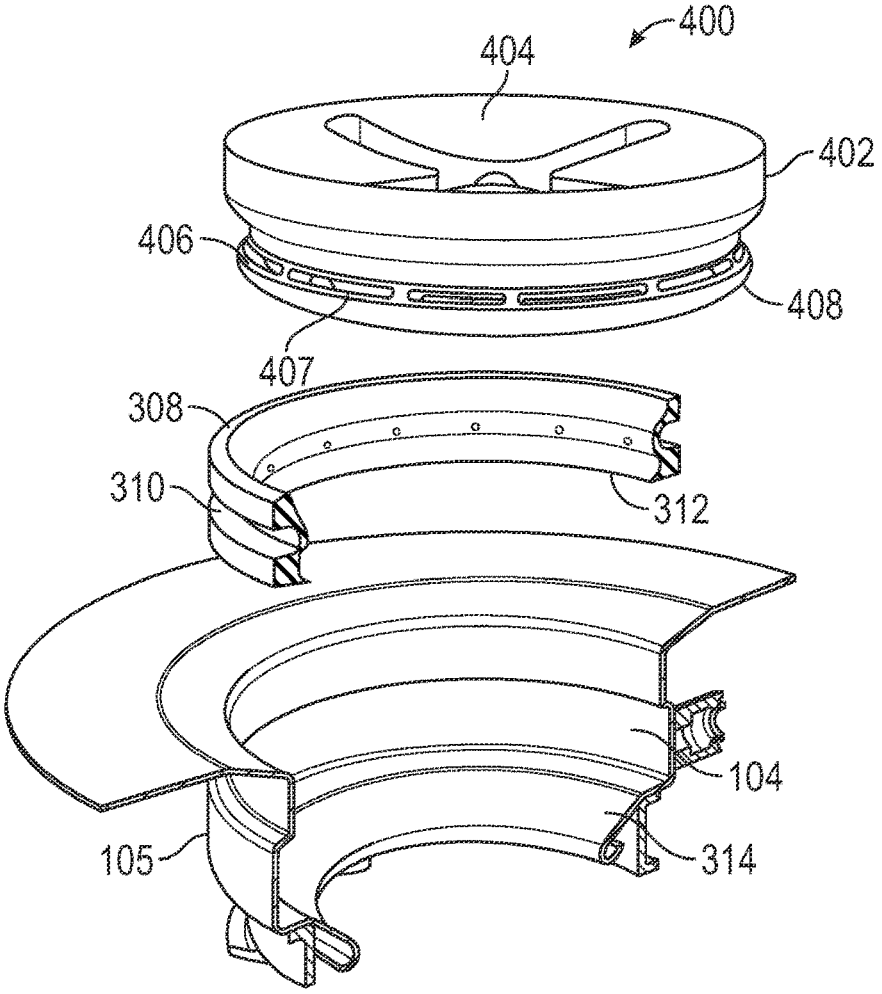
FIG. 22 is an exploded partial cutaway perspective view of a splashguard assembly.
Figure 23A:
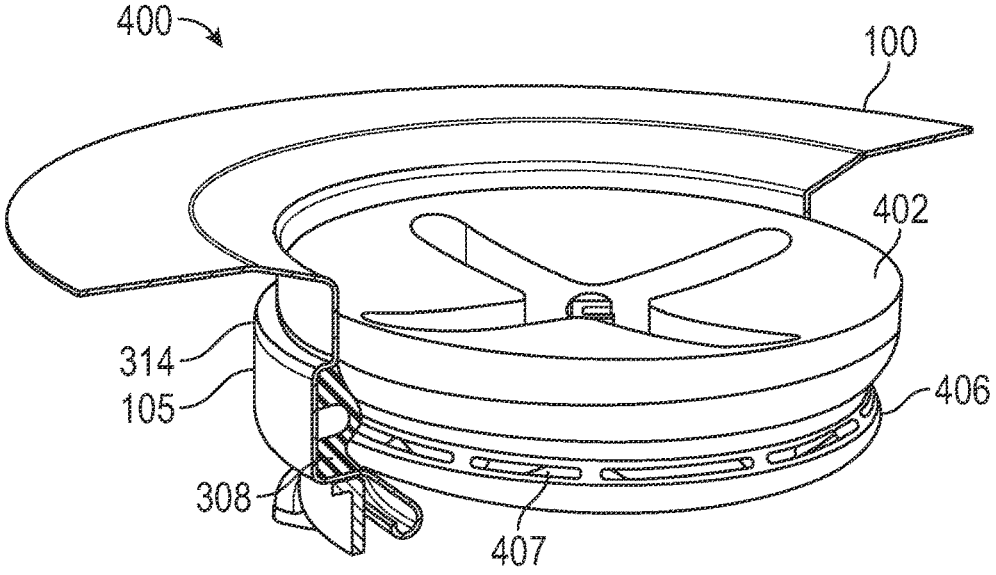
FIG. 23A is a partial cutaway perspective view of a splashguard assembly.
Figure 23B:
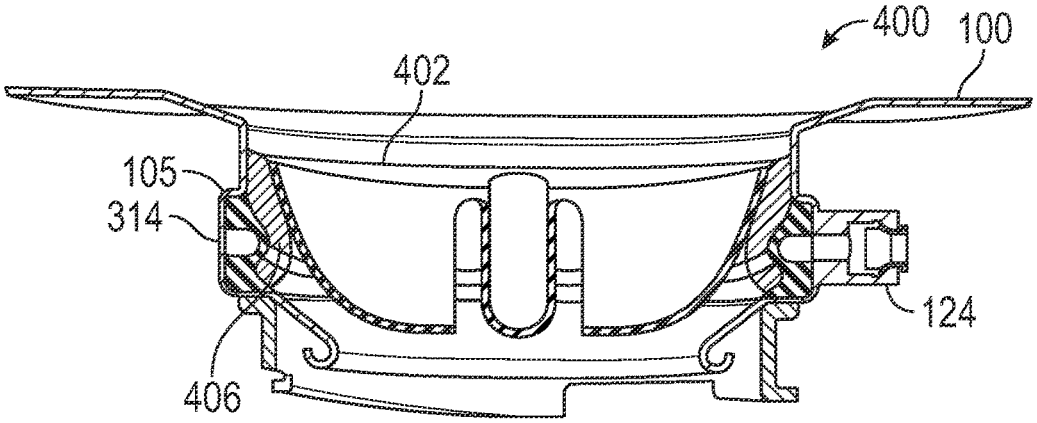
FIG. 23B is a cutaway side view of the splashguard assembly of FIG. 23A.

Referring now to FIGS. 22 and 23A-23B, another example of a splashguard assembly 400 includes for use in the seamless drain sink 100 with a garbage disposal system attached thereto (not shown) is depicted. In this example, a rubber splashguard 402 includes a plurality of inverted petals 404 as described supra, and a rigid co-molded spray ring 406 formed in a bottom side surface 408 of the splashguard 402 which includes a plurality of elongate fluid openings 407 in the form of slits. As described supra, the spray ring 308 including a fluid channel 310 and apertures 312 forming jets nests within an annular channel 314 of the sidewall 105 of the drain 104. The splashguard 402 nests within the drain 105 and the spray ring 308. In this example, the bottom side surface 408 corresponds to and abuts the inner surface of the spray ring 308 such that the fluid channel 310 of the spray ring 308 is in fluid communication with the spray ring 406 of the splashguard 402. The co-molded spray ring 406 provides structure for a snap-fit within the spray ring 308. In one non-limiting example, no more than two spray ring apertures 312 align with elongate fluid openings 407; however, more or less than two can be contemplated.

Figure 24:
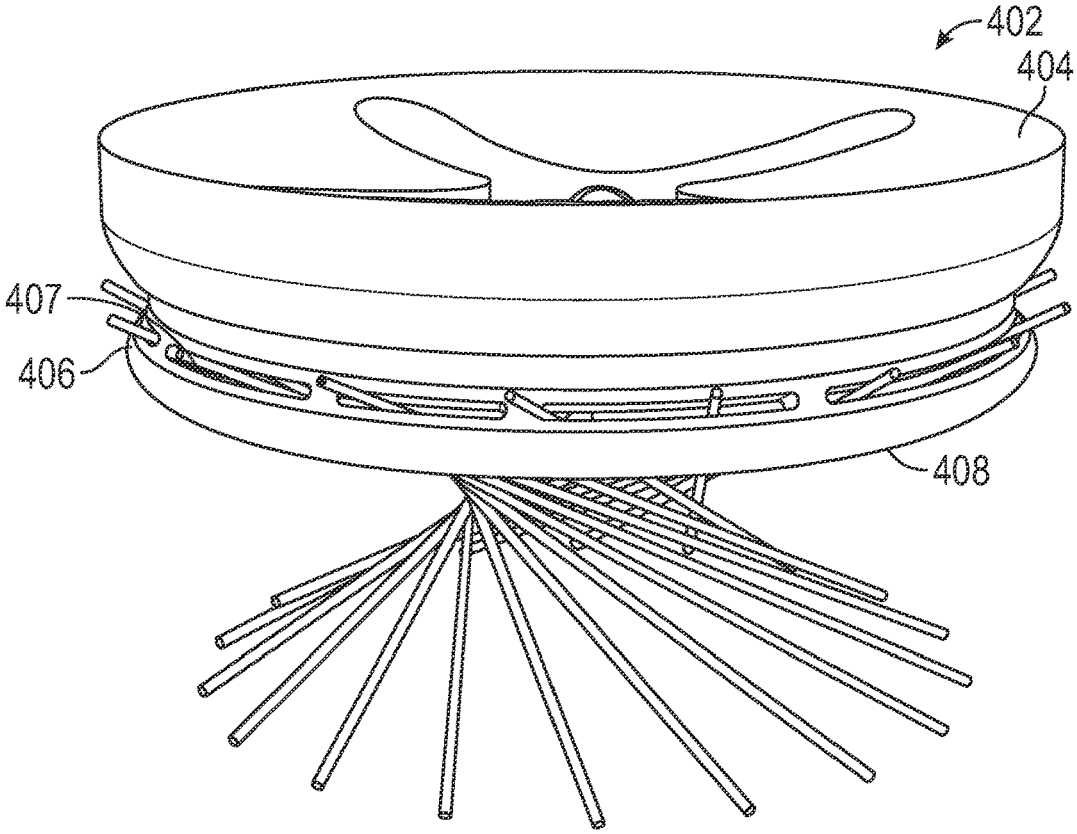
FIG. 24 is a perspective view of a splashguard assembly.
Figure 25A:
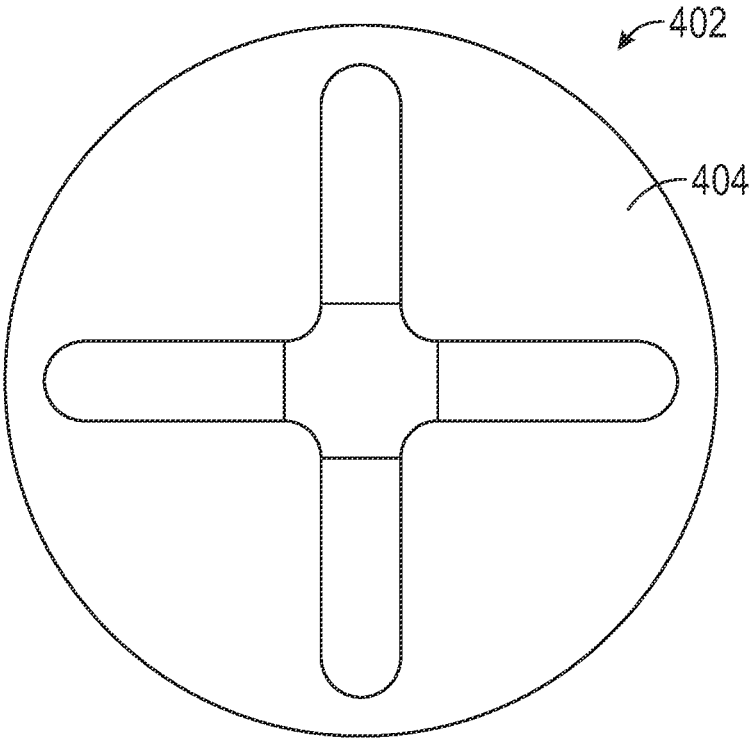
FIG. 25A is a top view of a splashguard.
Figure 25B:
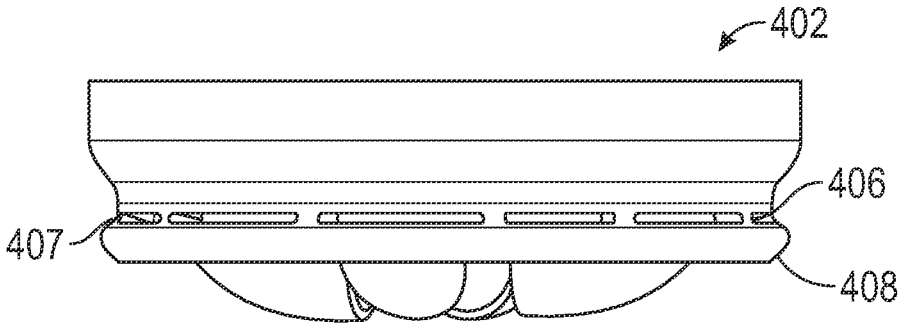
FIG. 25B is a side view of FIG. 25A.
Figure 26:
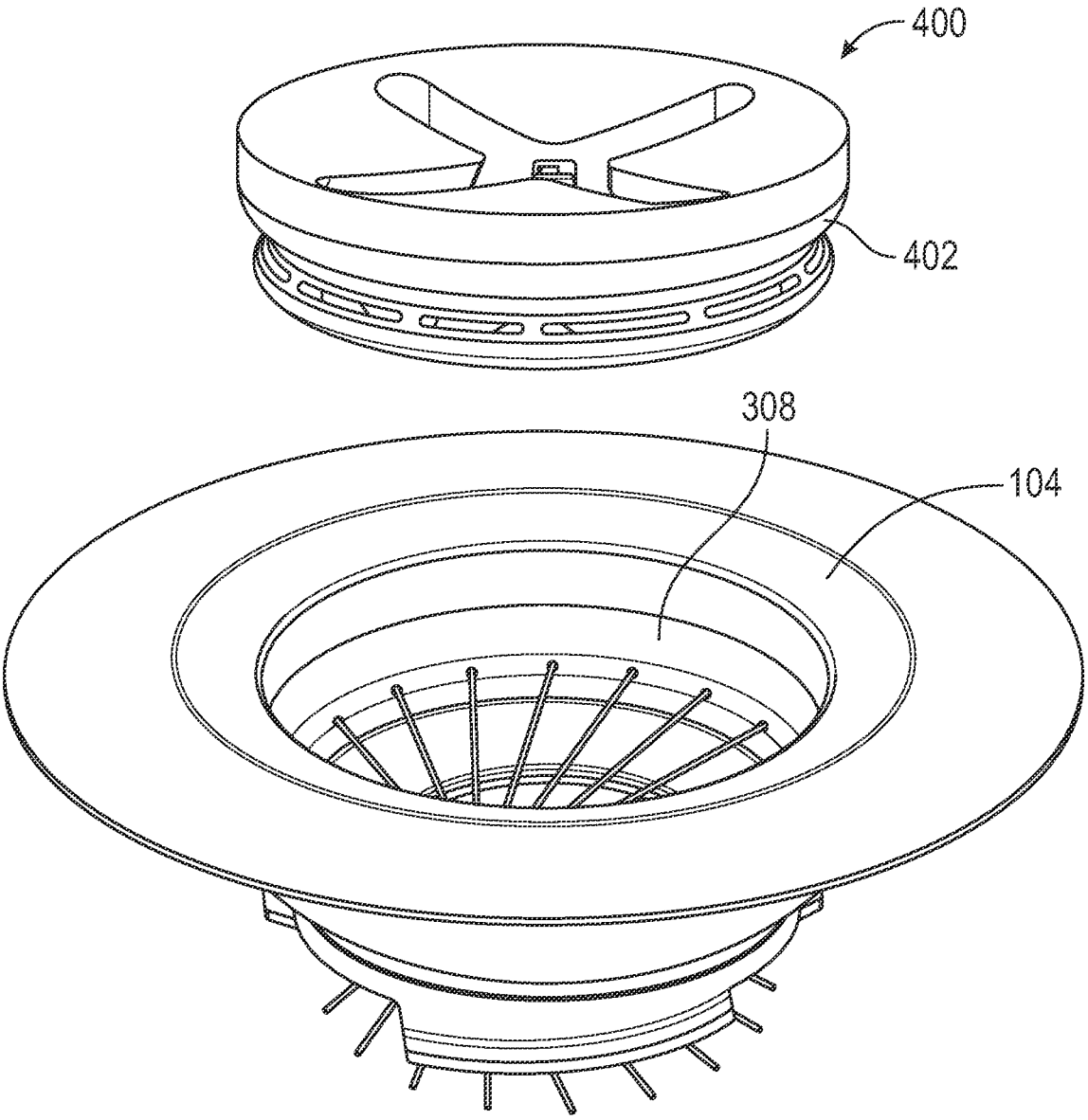
FIG. 26 is an exploded perspective view of a splashguard and a drain.

Referring to FIGS. 24 and FIG. 25A-25B, in use, the splashguard assembly 400 allows for fluid to enter the channel 314 from the fluid inlet 124 of drain 104. This fluid can be clean, gray, or filtered water, with an optional additive such as soap or a sanitizing additive, ozonated water, or similar sanitizing or cleaning additive. The fluid enters the channel 310 of the spray ring 308 and is forced through the apertures 312 of spray ring 308, and through fluid openings 407 of the splashguard 402, defining a plurality of jets entering under the splashguard 402 for rinsing, cleaning, or sanitizing under the splashguard 402 and in the drain 104 and entry into the disposal system if coupled to the drain 104. Referring to FIG. 26, the splashguard 402 can optionally be removed from the drain 104 in order for a user to see the fluid entering the drain 104 through the spray ring 308.

Figure 27:
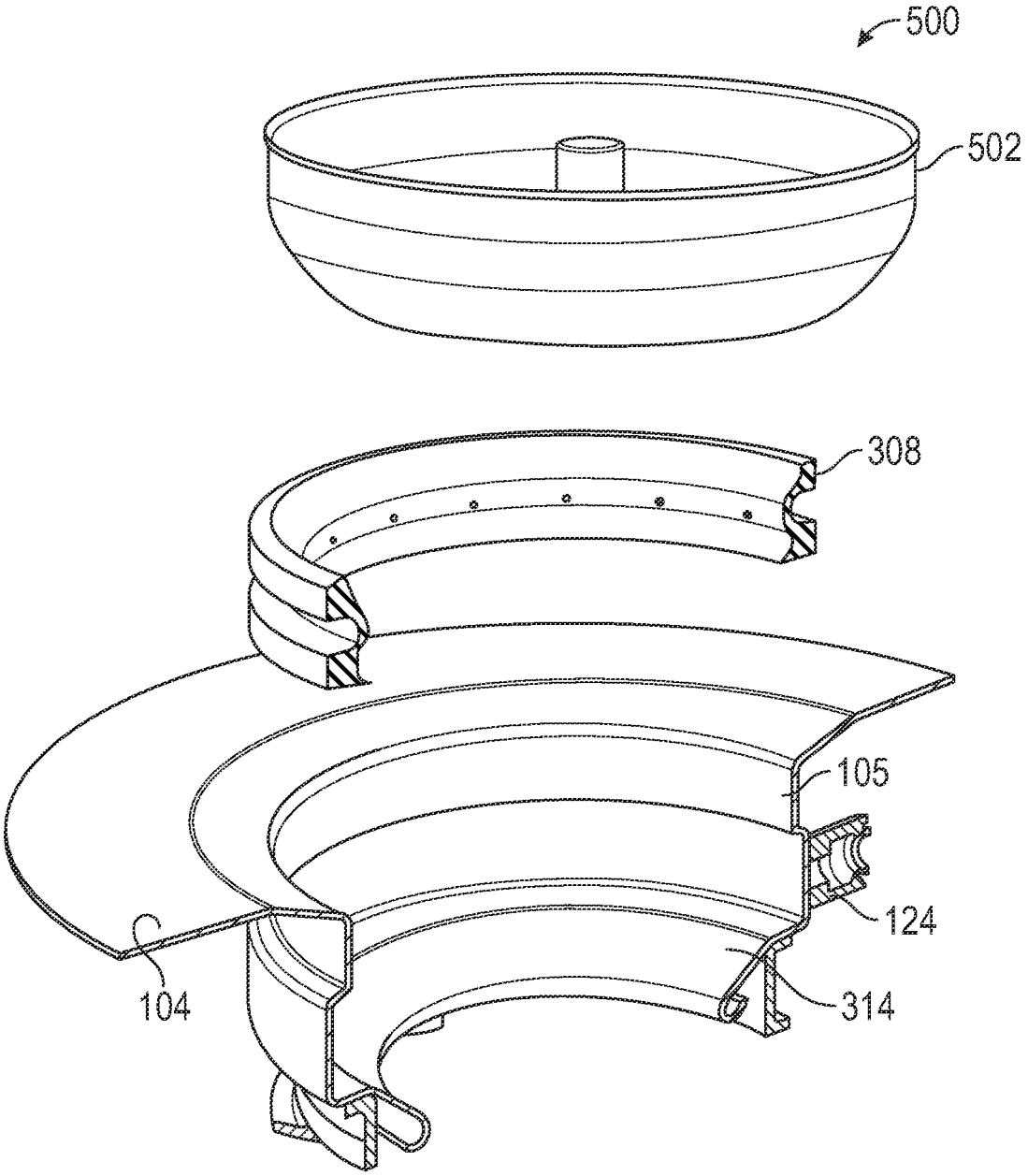
FIG. 27 is an exploded partial cutaway perspective view of a splashguard assembly.
Figure 28A:
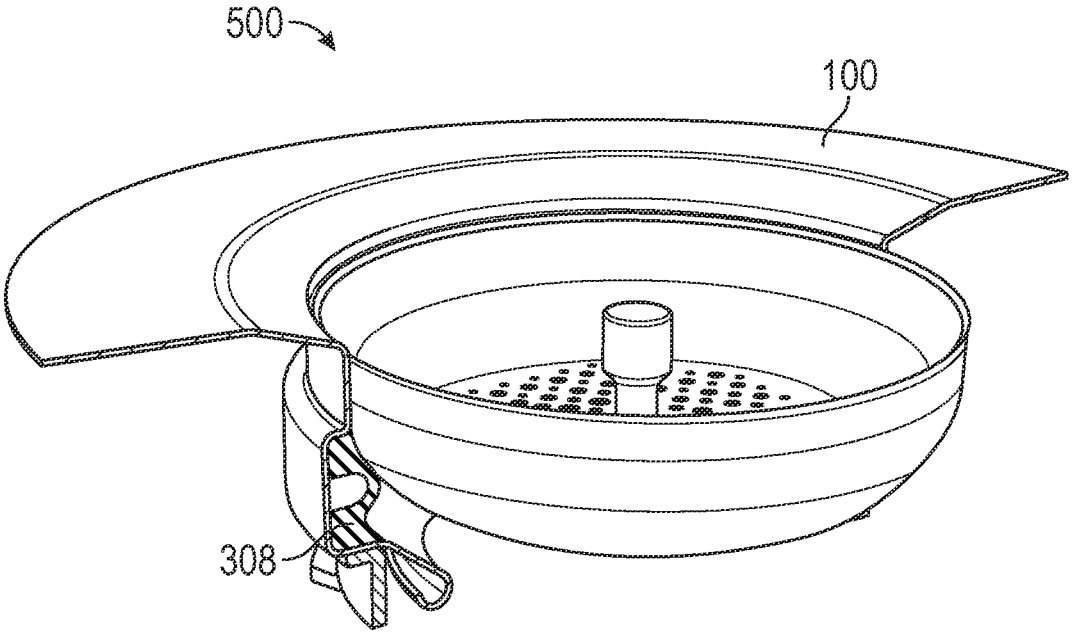
FIG. 28A is a partial cutaway perspective view of a splashguard assembly.
Figure 28B:
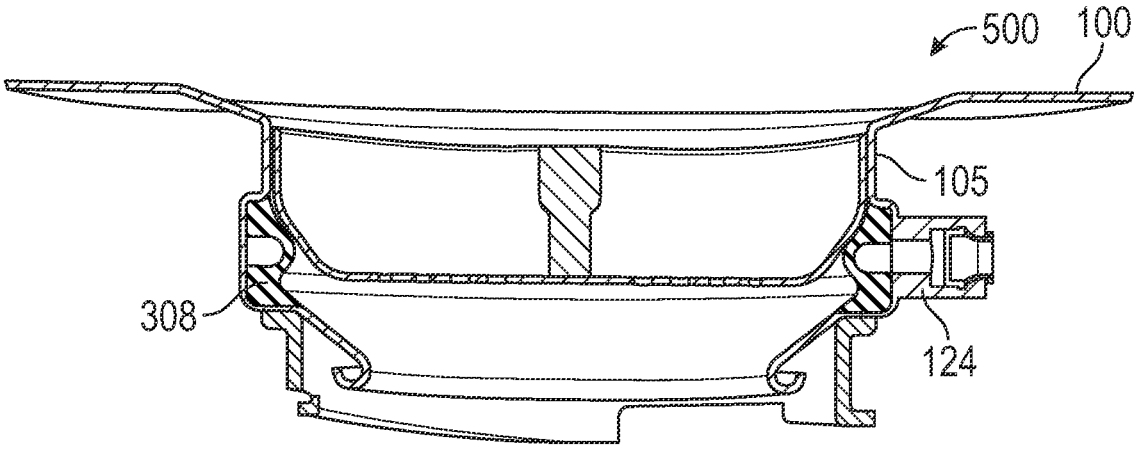
FIG. 28B is a cutaway side view of the splashguard assembly of FIG. 28A.
Figure 29A:
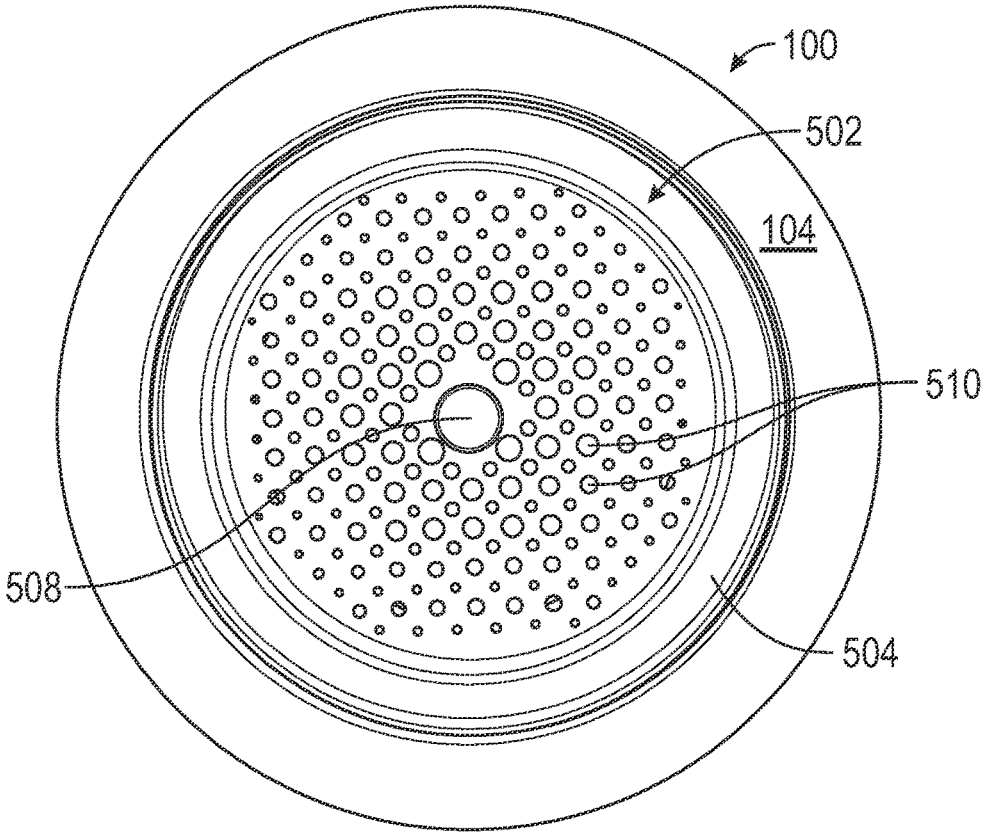
FIG. 29A is a top view of a sink system.
Figure 29B:
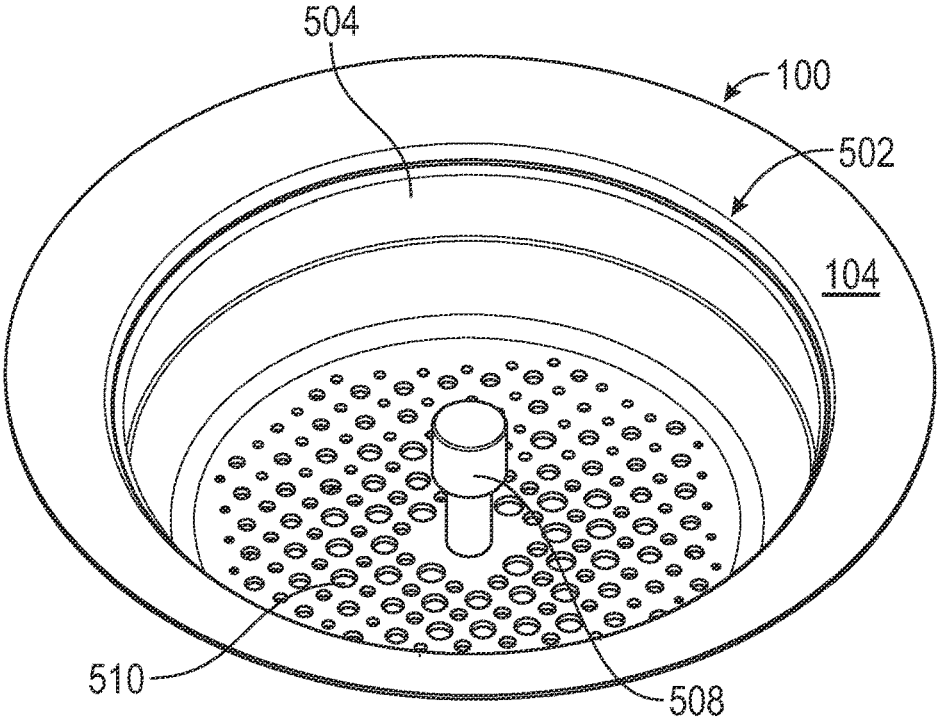
FIG. 29B is a perspective view of FIG. 29A.

Referring now to FIGS. 27 and 28A-28B, a duo strainer assembly 500 includes for use in the seamless drain sink 100 is depicted. In this example, instead of a rubber splashguard as described supra, a strainer basket 502 nests with drain 104 and abuts the spray ring 308 (as described above) nested within the channel 314 of the sidewall 105 of the drain 104. Referring to FIGS. 29A and 29B, the strainer basket 502 generally can include an annular sidewall 504, and a bottom surface 506 including a stem 508 and a plurality of apertures 510 for allowing fluid and small particles to pass through into the drain, while retaining larger particles on the bottom surface 506. In one example, apertures 510 include at least two different diameters, in which larger apertures 510 are concentrated towards a center of the bottom surface 506, and the diameter of the apertures decreases towards an outer perimeter or circumference of the bottom surface 506. In other alternative examples (not shown), the apertures are of equal diameter, or larger apertures are concentrated around the perimeter and are smaller moving inwardly. The stem 508 extends vertically upward from the bottom surface 506 at a high that is substantially flush with the sink 100 so that a cover can be placed over assembly 500, if desired.

Figure 30:
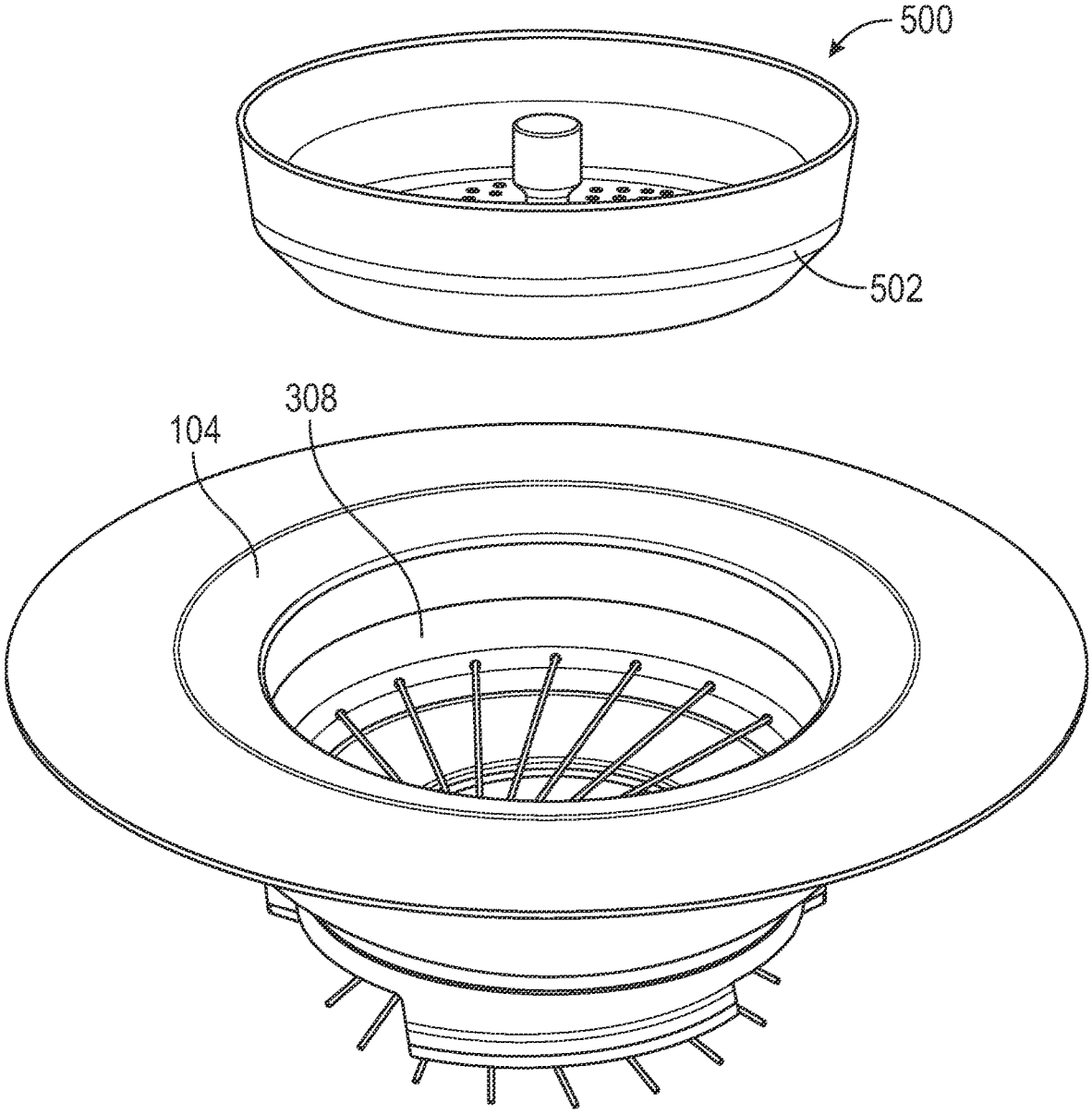
FIG. 30 is an exploded perspective view of a strainer assembly and a drain.

Referring to FIGS. 28B and 30, in use, the duo strainer assembly 500 allows for fluid to enter the channel 314 from the fluid inlet 124 of drain 104. This fluid can be clean, gray, or filtered water, with an optional additive such as soap or a sanitizing additive, ozonated water, or similar sanitizing or cleaning additive. The fluid enters the channel 310 of the spray ring 308 and is forced through the apertures 312 of spray ring 308, defining a plurality of jets entering under the strainer basket 502 for rinsing, cleaning, or sanitizing under the strainer basket 502 and in the drain 104 and entry into the disposal system if coupled to the drain 104. Referring to FIG. 30, the strainer basket 502 can optionally be removed from the drain 104 in order for a user to see the fluid entering the drain 104 through the spray ring 308.

In an example, a kit can include at least two of the splashguard 302, the splashguard 402, and the strainer basket 502 for interchangeable use with the spray ring 308 within the drain 104 of the sink 100.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein.

It should be understood that the individual operations used in the methods of the present teachings may be performed in any order and/or simultaneously, as long as the teaching remains operable. Furthermore, it should be understood that the apparatus and methods of the present teachings can include any number, or all, of the described examples, as long as the teaching remains operable.

Various examples of systems, devices, and methods have been described herein. These examples are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of this disclosure.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A drain system comprising:

a sink basin, wherein the sink basin is comprised of at least one sink sidewall and a sink bottom wall;

a drain seamlessly connected to the sink bottom wall, wherein the drain is comprised of at least one annular drain sidewall and the at least one annular drain sidewall is configured to extend below the sink bottom wall; and a plurality of attachment bayonets arranged around a perimeter of a distal end of the annular drain sidewall, each attachment bayonet separated by a gap and including an annular flange protruding in a direction transverse to the sidewall and including a generally flat surface, wherein each attachment bayonet is angled downward.

2. The drain system of claim 1, wherein the drain is welded to the sink bottom wall.

3. The drain system of claim 1 wherein the attachment bayonet is removably connected to the distal end of the drain sidewall.

4. The drain system of claim 1, wherein the attachment bayonet comprises at least one flange configured to rotatably engage with at least one corresponding tab on an attachment piece.

5. The drain system of claim 4, wherein the attachment piece comprises a garbage disposal.

6. The drain system of claim 4, wherein the attachment piece comprises a drainpipe adaptor.

* * * * *